US007694470B2

(12) United States Patent
Schultz et al.

(10) Patent No.: US 7,694,470 B2
(45) Date of Patent: Apr. 13, 2010

(54) MUNTIN CLIP

(75) Inventors: Steven E. Schultz, Rockford, IL (US); Dean Pettit, St. John, IN (US)

(73) Assignee: Newell Operating Company, Atlanta, GA (US)

( * ) Notice: Subject to any disclaimer, the term of this patent is extended or adjusted under 35 U.S.C. 154(b) by 1058 days.

(21) Appl. No.: 11/298,304

(22) Filed: Dec. 9, 2005

(65) Prior Publication Data

US 2006/0162282 A1 Jul. 27, 2006

Related U.S. Application Data

(60) Provisional application No. 60/635,123, filed on Dec. 10, 2004.

(51) Int. Cl.
*E06B 3/964* (2006.01)

(52) U.S. Cl. ..... 52/204.61; 52/204.59; 52/311.3; 52/314

(58) Field of Classification Search ..... 52/314, 52/311.3, 663, 204.61, 204.59, 844, 855, 52/656.9; 403/187, 255, 460, 298; 411/508, 411/509, 510, 913; 24/297, 453, 458
See application file for complete search history.

(56) References Cited

U.S. PATENT DOCUMENTS

| | | | | |
|---|---|---|---|---|
| 752,831 | A | | 2/1904 | Emerson |
| 1,101,745 | A | | 6/1914 | Jones |
| 1,376,806 | A | | 5/1921 | Graff |
| 1,998,671 | A | | 4/1935 | Hadjisky |
| 2,617,159 | A | | 11/1952 | Leighton |
| 3,053,353 | A | | 9/1962 | Miller |
| 3,096,861 | A | | 7/1963 | Frick et al. |
| 3,131,440 | A | | 5/1964 | Leeser |
| 3,352,078 | A | | 11/1967 | Neal |
| 3,889,434 | A | | 6/1975 | Shelver |
| 4,106,239 | A | | 8/1978 | Bancroft et al. |
| 4,530,195 | A | | 7/1985 | Leopold |
| 4,546,723 | A | | 10/1985 | Leopold et al. |
| 4,570,399 | A | | 2/1986 | Wentink |
| 4,628,582 | A | | 12/1986 | Leopold |
| D292,871 | S | * | 11/1987 | Hayashi ..... D8/354 |
| 4,949,521 | A | | 8/1990 | Riegelman et al. |
| 5,099,626 | A | * | 3/1992 | Seeger ..... 52/314 |
| 5,105,591 | A | | 4/1992 | Leopold |
| 5,203,135 | A | * | 4/1993 | Bastian ..... 52/848 |

(Continued)

FOREIGN PATENT DOCUMENTS

| | | | |
|---|---|---|---|
| DE | 3404957 | A1 | 9/1984 |

(Continued)

*Primary Examiner*—Richard E Chilcot, Jr.
*Assistant Examiner*—Joshua Ihezie
(74) *Attorney, Agent, or Firm*—Banner & Witcoff, Ltd

(57) ABSTRACT

A muntin clip has a bar support adapted to be connected to a muntin bar end and a base member adapted to be connected to a spacer frame. The bar support has a plurality of flexible support members attached thereto, which are adapted to contact the opposed interior walls of the muntin bar end and deform in response to such contact. The base member has two flexible members forming a flexible latching structure which is adapted to deform when inserted into the spacer frame. The muntin clip to be used with muntin bars and spacer frames having a range of different dimensions and configurations.

14 Claims, 14 Drawing Sheets

U.S. PATENT DOCUMENTS

| | | | | |
|---|---|---|---|---|
| 5,295,292 | A | 3/1994 | Leopold | |
| 5,313,761 | A | 5/1994 | Leopold | |
| 5,361,476 | A | 11/1994 | Leopold | |
| 5,456,048 | A * | 10/1995 | White | 52/204.61 |
| 5,477,647 | A | 12/1995 | Yates | |
| 5,595,033 | A | 1/1997 | Frey | |
| 5,657,590 | A * | 8/1997 | Digman et al. | 52/204.61 |
| 5,678,376 | A * | 10/1997 | Poma | 52/656.8 |
| 5,678,377 | A * | 10/1997 | Leopold | 52/656.9 |
| 5,702,146 | A | 12/1997 | Asami | |
| 6,115,989 | A * | 9/2000 | Boone et al. | 52/786.13 |
| 6,173,484 | B1 | 1/2001 | McGlinchy et al. | |
| 6,192,631 | B1 | 2/2001 | Kenkel et al. | |
| 6,244,012 | B1 | 6/2001 | McGlinchy et al. | |
| 6,301,843 | B1 * | 10/2001 | Silverman | 52/204.5 |
| 6,345,485 | B1 * | 2/2002 | Boone et al. | 52/786.13 |
| 6,364,589 | B1 * | 4/2002 | Wenglinski | 411/508 |
| 6,397,453 | B1 | 6/2002 | McGlinchy et al. | |
| 6,425,221 | B1 * | 7/2002 | Reichert | 52/456 |
| 6,438,819 | B1 | 8/2002 | McGlinchy et al. | |
| 6,494,002 | B1 | 12/2002 | Gieseke | |
| 6,536,182 | B2 | 3/2003 | France | |
| D478,675 | S | 8/2003 | France | |
| D478,676 | S | 8/2003 | France | |
| D478,677 | S | 8/2003 | France | |
| D478,678 | S | 8/2003 | Hornung et al. | |
| D479,005 | S | 8/2003 | France | |
| D479,006 | S | 8/2003 | Hornung et al. | |
| 6,662,512 | B2 | 12/2003 | Westphal | |
| 6,729,091 | B1 * | 5/2004 | Martensson | 52/391 |
| 6,804,920 | B2 | 10/2004 | Hogan | |
| 6,898,914 | B2 | 5/2005 | Folsom et al. | |
| 7,124,546 | B2 * | 10/2006 | Scharff et al. | 52/314 |
| 2001/0034990 | A1 * | 11/2001 | Reichert | 52/456 |
| 2002/0069823 | A1 | 6/2002 | Briese et al. | |
| 2002/0108228 | A1 | 8/2002 | McGlinchy et al. | |
| 2002/0138964 | A1 | 10/2002 | McGlinchy | |
| 2002/0157769 | A1 | 10/2002 | McGlinchy | |
| 2002/0170159 | A1 | 11/2002 | McGlinchy et al. | |
| 2002/0189196 | A1 | 12/2002 | Hornung et al. | |
| 2002/0189743 | A1 | 12/2002 | Hornung et al. | |
| 2003/0084622 | A1 | 5/2003 | Hornung et al. | |
| 2003/0084989 | A1 | 5/2003 | Briese | |
| 2003/0089054 | A1 | 5/2003 | Hornung | |
| 2003/0093960 | A1 | 5/2003 | Mizusawa et al. | |
| 2003/0126812 | A1 | 7/2003 | Folsom et al. | |
| 2003/0131558 | A1 | 7/2003 | France | |
| 2004/0123557 | A1 * | 7/2004 | Hornung et al. | 52/786.13 |
| 2005/0235586 | A1 * | 10/2005 | Hornung et al. | 52/204.61 |

FOREIGN PATENT DOCUMENTS

| | | |
|---|---|---|
| GB | 2106580 | 4/1983 |
| JP | 1-198984 | 8/1989 |

* cited by examiner 300
302
306
308
310
311
312
313
314
314a
315
316
317
320
321
322
323a
323b
325
327
400
402
404
406
408
409
410
411
412
412a
413
414
414a
415
416
417
418
420
421
422
423a
423b
424
425
426
427

MUNTIN CLIP

CROSS-REFERENCE TO RELATED APPLICATIONS

This application claims the benefit of U.S. Provisional Application Ser. No. 60/635,123, filed Dec. 10, 2004, which is incorporated by reference herein and made a part hereof.

TECHNICAL FIELD

This invention relates generally to muntin grids for sash window assemblies and more specifically to a muntin clip for positioning the grid within a sash window.

BACKGROUND OF THE INVENTION

Double hung window assemblies typically include a pair of sash windows slidably mounted within a master frame. In the past, sash windows were provided with a grid of muntin bars, typically made of wood, that separated and held multiple panes of glass within a sash. Each pane would be mounted within the sash in the same plane. Now, double or multiple pane windows are provided, otherwise known as insulated or thermo-pane window assemblies. These insulated window assemblies include a pair of glass panes mounted in parallel relation to one another within a sash frame and separated by a small distance. The panes are typically separated by a spacer frame located about a periphery of the panes. Of course, insulated or thermo pane windows are not limited to single or double hung window arrangements. Rather, they have a wide range of applications that are well known in the art. For instance, double pane windows may be incorporated in doors, picture windows, etc.

Grids formed by interconnected muntin bars are often installed between these glass panes of a double pane or insulated sash window. Typically, these grids are comprised of multiple muntin bars arranged in a grid pattern and interconnected at interior intersecting points by muntin joiners. The grid is then placed between the panes of glass. The periphery of the grid is then mounted to the sash frame, or more typically, to a spacer frame separating the panes, by a series of muntin clips. It is understood that the grid can take a variety of different forms.

Typically, the muntin bars are of a tubular or hollow construction and a portion of the clip is received by an end of a muntin bar located at a periphery of the grid. Typically, the hollow muntin bar receives an extension or bar support of the clip that is designed to fit tightly within the hollow muntin bar to effect an interference fit, thereby attaching the muntin clip to the muntin bar end. (See FIG. 3) The clip in turn is attached or connected in some way to the spacer frame. An example of a prior art muntin clip is shown in cross section in FIG. 3. The prior art muntin clip 1 includes a bar support 2, in the form of a tree, tightly fitting within and received by a muntin bar 3.

Muntin grids, including the bars, joiners and clips of which they are comprised, come in numerous shapes and sizes. One drawback resulting from this fact is that muntin clip manufactures must design and produce a separate clip to match each potential size/shape of muntin bar available on the market and to also match with a variety of sizes of spacer frames. A conservative estimate is that there are currently at least 500 muntin clip designs available on the market to accommodate the multitude of sizes and shapes that can be found in the available muntin bars. This costs clip manufacturers, and window manufacturers or assemblers to incur costs associated with maintaining and otherwise dealing with large and varied inventories of muntin clips.

FIGS. 4-5 show a spacer frame. The spacer frame typically has a lateral wall having a length C, a pair of vertical walls having a height B, and a pair of shoulders, each having a length X. The shoulders are separated by a distance A. As one might expect, various window designs may and do require variously sized spacer frames. Typically, a manufacturer will adjust the length of the lateral wall C to accommodate window designs having differing widths between their multiple panes of glass. However, for each different value of C (length of lateral or bottom wall), the height B of the vertical wall and the length of the shoulder X remain as constants. Therefore, as the length C of the lateral wall varies between the various required spacer frame designs, the distance A between the shoulders also varies. This distance plays a role in determining what muntin clip may be used with a particular spacer frame.

Accordingly it can be seen that there are at least two factors dictating what type or design of muntin clip may be used in a particular window assembly. First is the configuration of the muntin bar to be used. The second factor is the configuration of the spacer frame. The multitude of variations available in both muntin bars and spacer frames results in the present existence of at least 500 different muntin clip designs currently being available. This in turn causes clip manufacturers and window assemblers to be burdened with large clip inventories.

The present invention is provided to solve these and other problems.

SUMMARY OF THE INVENTION

The present invention provides a muntin clip having an overall flexible support structure that allows the clip to be connected to a plurality of muntin bars and spacer frames having a variety of sizes.

According to one aspect of the invention, the muntin clip has a bar support having a plurality of flexible support members attached thereto, which are adapted to contact the opposed interior walls of the muntin bar end and deform in response to such contact.

According to another aspect of the invention, the bar support has a first set of flexible members extending outwardly from the trunk, and a second set of flexible members attached to the trunk and extending in a direction substantially parallel to the trunk.

According to another aspect of the invention, the muntin clip has a base member attached to the bar support and having two flexible members forming a flexible latching structure which is adapted to deform when inserted into the spacer frame.

According to another aspect of the invention, each of the flexible members has a cross-member at the free end and a pair of resilient tabs depending from the cross-member.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
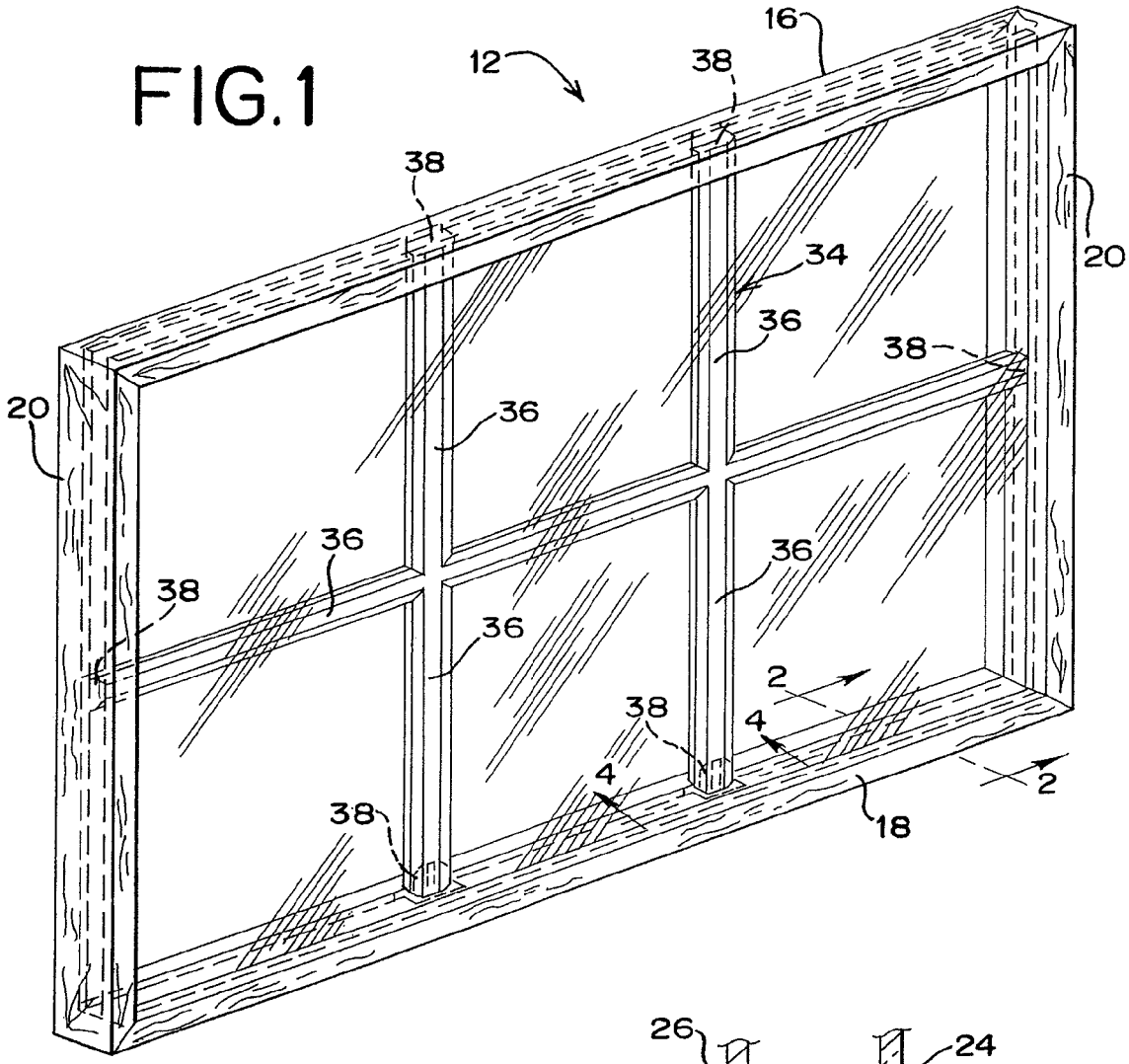
FIG. 1 is a perspective view of a window assembly including a muntin grid.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a sash window 12 comprised of a top sash rail 16, a base sash rail 18 and a pair of vertical stiles 20. Although not shown, the sash window 12 may be mounted, slidingly or otherwise, within a master frame, such as, in a single or double hung window arrangement as is well known in the art. It is also understood that other hardware can be incorporated into the sash window 12 as is known in the art.

Figure 2:
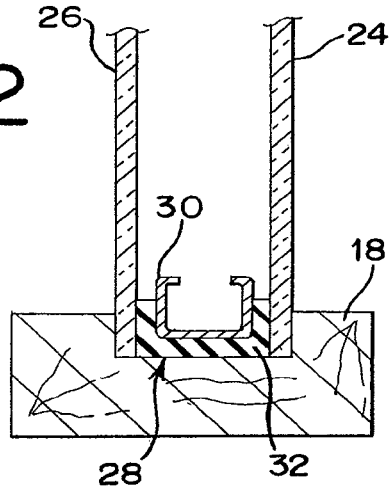
FIG. 2 is a partial cross sectional view of the window assembly of FIG. 1 taken along the line 2-2.

As shown in FIG. 2, each sash window 12 also includes a first pane of glass 24 and a second pane of glass 26 mounted in parallel relationship to one another within an interior of the sash window 12. The first and second panes 24, 26 are spaced by a spacer assembly 28 located at a periphery of the panes 24, 26. The spacer assembly 28 comprises a spacer frame 30 and a seal or sealant 32. The spacer frame 30 is generally tubular with a rectangular or square cross section as seen in FIG. 2. The spacer frame 30 extends about the entire periphery of the first and second panes 24, 26. A seal or sealant 32 is applied to an outer region of the spacer frame 30. When pressed between the first and second panes 24, 26, the spacer frame 30 forms an air tight seal between the two panes 24, 26.

A muntin grid 34 (FIG. 1) is positioned between the first and second panes of glass 24, 26. The muntin grid 34 is comprised of a plurality of interconnecting muntin bars 36. Each muntin bar 36 has a generally tubular and hollow construction. Various means of interconnecting the muntin bars 36 are known to those of ordinary skill in the art. The connecting means are not further described herein and any means of connecting or joining the muntin bars 36 to one another may be utilized. As can be seen from the figures, the muntin bars 36 are so interconnected to form a grid 34 which is positioned between the first and second panes of glass 24, 26. Extending towards and located at a periphery of the grid 34 are a plurality of muntin bar ends 38. It is understood that the grid 34 can take a variety of forms.

Figure 4:
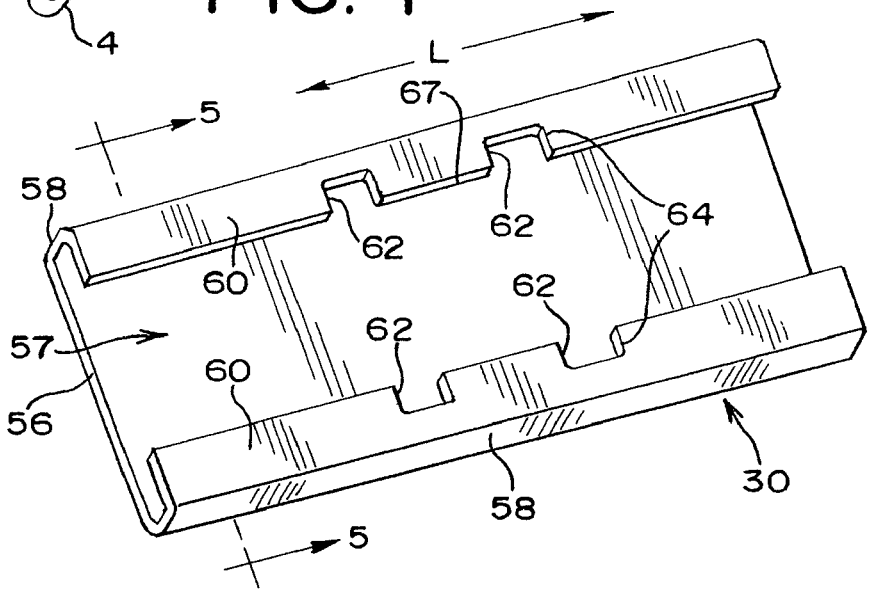
FIG. 4 is a partial isometric view of a spacer frame according to the present invention.
Figure 5:
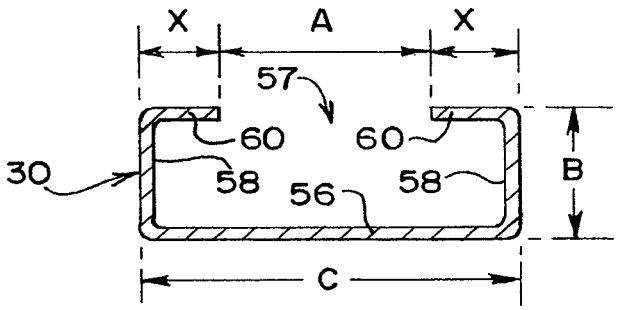
FIG. 5 is a cross section view of the spacer frame of FIG. 4 taken along the line 5-5 of FIG. 4.

FIGS. 4-5 depict the spacer frame 30. FIG. 4 shows only a portion of the length of the spacer frame 30. It can be seen that the spacer frame is generally U-shaped and includes a lateral wall 56 and a pair of vertical walls 58 extending in the same direction from the lateral wall 56. Each vertical wall 58 includes an inwardly extending shoulder 60 located near an end of its respective vertical wall 58 distal from the lateral wall 56. The shoulders 60 are separated by a distance A, defining an elongated opening 57 in the top of the spacer frame 30. The vertical walls 58 each have a height B. The lateral wall 56 has a length C and the shoulders 60 each have a length X. Spaced along a length of an inner edge of the shoulders 60 are a plurality of notches 62 (FIG. 4) adapted to receive the mount structure 104 of the clip 100, to be explained. It can be seen that each notch 62 on one shoulder 60 is generally opposed from a corresponding notch 62 on the other shoulder 60. The opposed notches 62 form a pair of notches 64. It can also be seen that two notch pairs 64 are usually located in proximity to one another. It is understood that the two notch pairs 64 are but one preferred embodiment.

Figure 15:
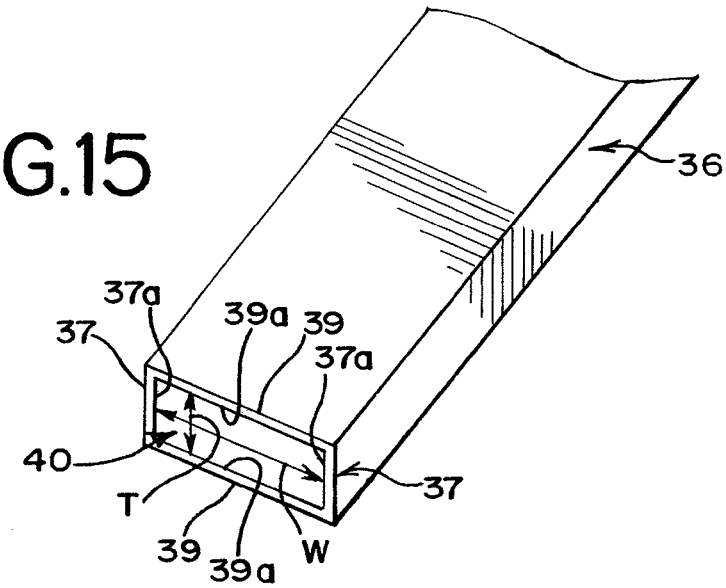
FIG. 15 is a partial perspective view of a muntin bar end according to the present invention.

A typical muntin bar end 38 is shown in FIG. 15, and includes opposed side walls 37 spaced by a distance W and opposed lateral walls 39 spaced by a distance T. Each muntin bar end 38 is normally hollow and rectangular (although other shapes are possible), and has an interior cavity 40 with interior walls 37*a* and interior walls 39*a* formed by opposed side walls 37 and opposed lateral walls 39 respectively. The muntin bar 36 may have a solid peripheral structure or formed from a flat segment of material and folded into a tubular structure. In such configuration, the muntin bar 36 has an open seam extending along a length of the bar 36.

A muntin clip 100 mounts each muntin bar end 38 to the sash window 12, to be explained. One preferred embodiment of the muntin clip 100 according to the present invention is illustrated in FIGS. 6-10. Each muntin clip 100 includes a base or base member 102 and a bar support 106. The base 102 is adapted to mount the clip 100 to the spacer frame 30, and the bar support 106 is adapted to connect the clip 100 to the muntin bar end 38. As explained in greater detail below, the base 102 and bar support 106 each have flexible latching or support structure that enhances the connectability of the muntin clip 100 to the spacer frame 30 and the muntin bar end 38.

The bar support 106 is adapted to be inserted in the interior cavity 40 of the hollow muntin bar end 38 to support the muntin bar within the muntin grid 34. Preferably, the bar support 106 fits relatively tightly within the muntin bar end 38. The preferred embodiment of the bar support 106 is shown in FIGS. 6-10 and includes a trunk 116 extending from the base 102 and a plurality of flexible trunk members 121 extending from the trunk. Among these flexible members are flexible fingers 122 extending outwardly from the trunk 116, and flexible arms 123 extending alongside the trunk 116. The trunk 116 has a first end 118 attached to the base 102 and a second end 120 distal from the base 102. In the preferred embodiment, the trunk 116 also has a central hub 117 from which a plurality of the flexible members 121 project. Preferably, the trunk 116 is constructed thickly so that it is sufficiently rigid to support the muntin bar 36. It is further understood that the central hub 117 could be defined in alternative configurations such that in one embodiment, the flexible fingers 122 extend from the central hub 117, and in another embodiment, the flexible fingers 122 extend from the flexible arms 123.

The preferred bar support 106 is shown in FIGS. 6-10 and has four flexible fingers 122 extending outwardly from the trunk 116. These flexible fingers 122 can be considered a first, second, third, and fourth flexible trunk members 121. Each flexible finger 122 has a fixed end 124 attached to the trunk 116 and a free end 126 extending outwardly from the trunk 116. The fingers 122 are preferably flexible and deflectable, yet resilient. This structure permits each free end 126 to flex towards and away from the trunk 116. In the preferred embodiment, two flexible fingers 122 extend from the trunk 116 in opposed directions proximate the second end 120 of the trunk 116, and two flexible fingers 122 extend in opposed directions from the central hub 117 of the trunk 116. The fingers 122 preferably extend at least an appreciable distance generally perpendicularly outward from the trunk 116, and all the fingers 122 preferably extend within a general plane. Additionally, the fingers 122 preferably extend at least slightly downward (i.e. toward the base 102), which facilitates flexing and insertion of the bar support 106 into the muntin bar end 38. When the bar support 106 is inserted into the muntin bar end 38, the fingers 122 contact one pair of the opposed interior walls 37*a* of the muntin bar end 38 and substantially deflect, flexing inwardly and downwardly, in response to the contact, as described in greater detail below. The flexible fingers 122 extend a distance past the flexible arms 123 and generally to an outer lateral dimension defined by base 102.

In alternate embodiments, the bar support 106 may have a greater or fewer number of fingers 122. For example, the bar support 606 in FIGS. 24-25 has only two fingers 622 projecting from the distal end 620 of the trunk 616. Further, the fingers 122 may be longer or shorter, as and may extend at a greater or lesser downward angle than those shown. In addition, the material used to form the clip 100 can be varied to control the deflectability, resiliency, or overall flexibility of the flexible members 122,123. In one preferred embodiment, the clip 100 is formed from plastic in an injection-molded process. It is understood that a variety of other materials can be utilized.

The preferred bar support 106 has four flexible arms 123 extending from the central hub 117 of the trunk 116 and alongside the trunk 116. These flexible arms 123 can be considered a first, second, third, and fourth flexible trunk members 121. In other embodiments, such as the embodiment 400 shown in FIGS. 20-21, two of the arms 423 are attached proximate the distal end 420 of the trunk 416, and two of the arms 423 are attached to the central hub 417. In any case, the arms 123 are preferably substantially parallel to the trunk 116, extending a short distance away from the trunk 116 and then angling sharply to run nearly parallel to the trunk 116. Two of the arms 123 point upward (i.e. away from the base 102), and two of the arms 123 point downward (i.e. toward the base 102). In one preferred embodiment (FIGS. 6-10), two of the arms 123 point toward one of the pairs of fingers 122, and the other two arms 123 point away from one of the pairs of fingers 122.

Figures 8, 9, 10:
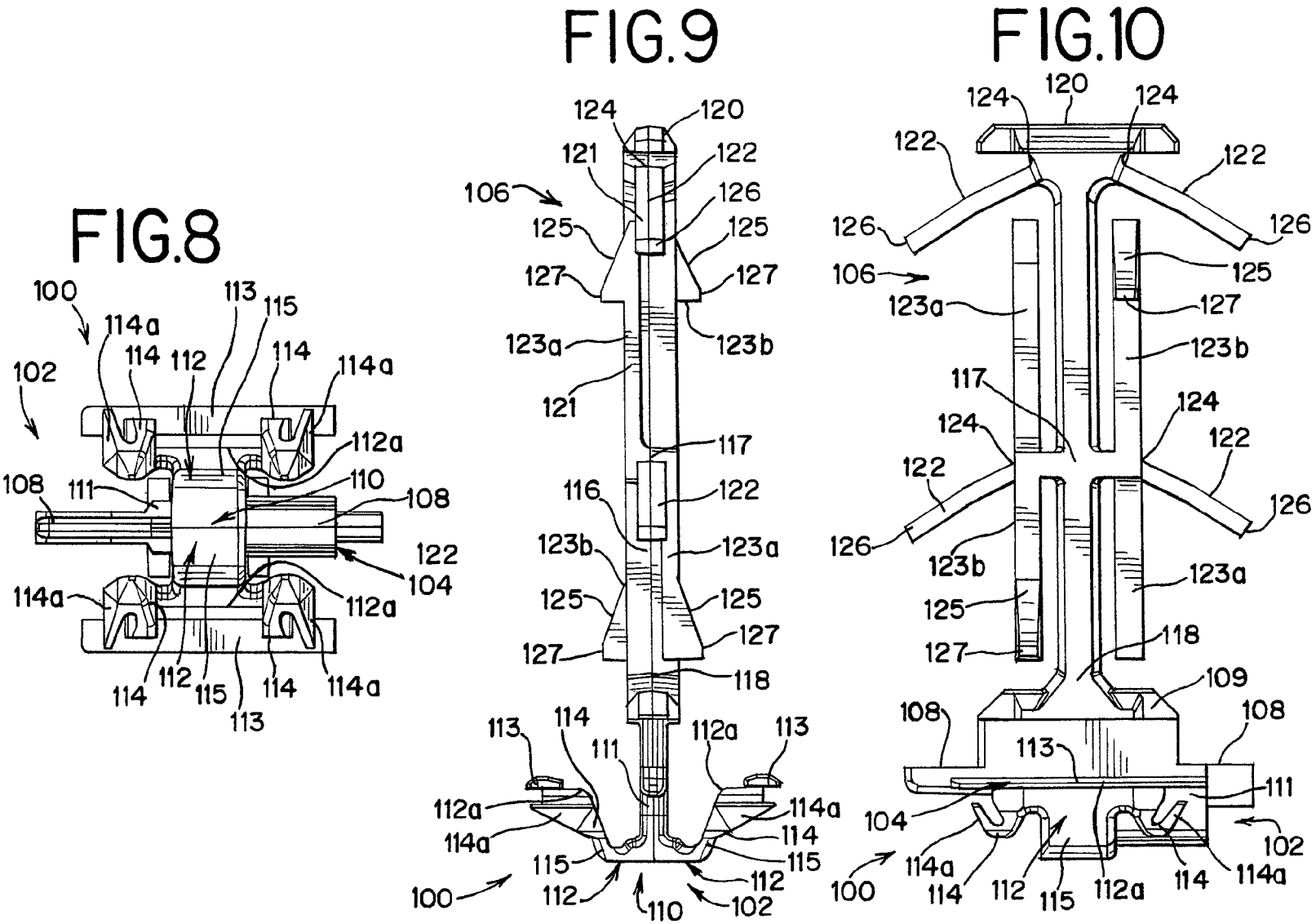
FIG. 8 is a bottom view of the muntin clip of FIG. 6
FIG. 9 is a side view of the muntin clip of FIG. 6.
FIG. 10 is a front elevation view of the muntin clip of FIG. 6.

As may be seen in FIG. 9, a portion of each arm 123 preferably protrudes out of the general plane occupied by the trunk 116 and fingers 122, discussed above. In other words, a portion of each arm 123 protrudes in a direction that is transverse to the directions in which the trunk 116 and the fingers 122 extend. In the preferred embodiment, each arm 123 contains a projection 127 protruding relatively perpendicularly outward from the tip. Thus, each projection 127 preferably protrudes in a direction that is transverse to the directions in which the trunk 116 and the fingers 122 extend. These projections 127 each preferably contain a beveled portion 125 facing upward (i.e. away from the base 102), to prevent snagging when the bar support 106 is inserted into the muntin bar end 38. It is understood that the projection and beveled portion When the bar support 106 is inserted into the muntin bar end 38, the projections 122 contact one pair of the opposed interior walls 39*a* of the muntin bar end 38, and generally not the pair of interior walls 37*a* contacted by the fingers 122. In response to this contact, the arms 123 substantially deflect, flexing inwardly, as described in greater detail below.

Figure 7:
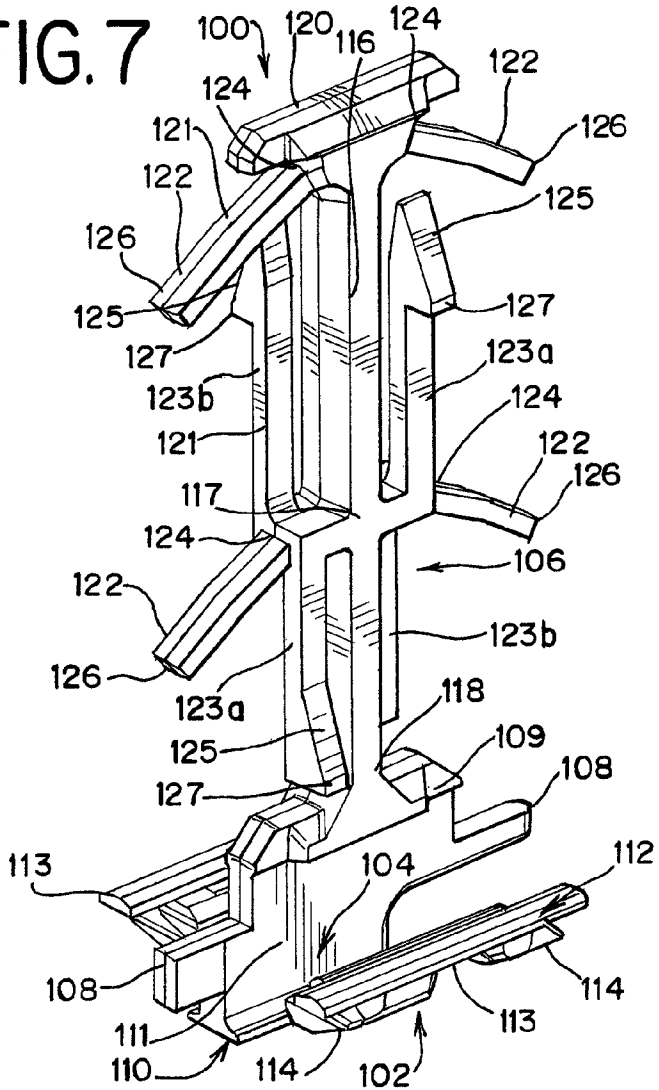
FIG. 7 is a perspective view of the muntin clip of FIG. 6.
Figure 6:
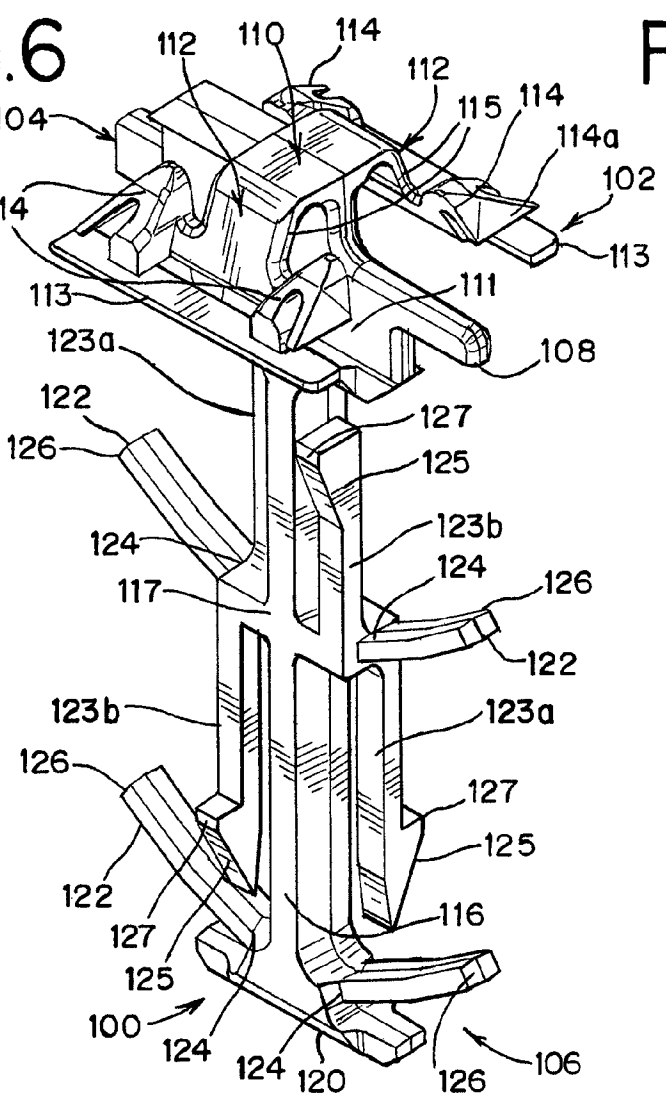
FIG. 6 is a bottom perspective view of a first embodiment of a muntin clip according to the present invention.

Generally, some of the arms 123 have a portion protruding in one direction and some of the arms 123 have a portion protruding in the opposite direction, creating a balance of pressure on the interior walls of the muntin bar end 38. For reference purposes, the arms 123 can be divided into "sets" based on the direction in which the respective projections 127 thereon project. Generally, as shown with reference to FIGS. 7 and 9-10, the bar support 106 will have one set 123*a* of arms 123 having forward-facing projections and one set 123*b* of arms 123 having rearward-facing projections. In the preferred embodiment, illustrated in FIGS. 6-10, the two arms 123 of each set are located cater-corner from each other. For example, with reference to FIGS. 7 and 9-10, one set of cater-corner arms 123*a* have projections 127 facing forward, and the other set of cater-corner arms 123*b* have projections 127 facing rearward. In other words, in FIG. 10, if one were to schematically draw or envision a line between the projections 127 of the arms 123*a* of the first set and a separate line between the projections 127 of the arms 123*b* of the second set, the two lines would tend to form an 'X'. The embodiments 200, 400 shown in FIGS. 16-17 and FIGS. 20-21 contain a similar arrangement. In the embodiments 300, 500 shown in FIGS. 18-19 and FIGS. 22-23, the arms 323, 523 of each set are located adjacent each other. The set of arms 323*a*,523*a* located closest to the base 302,502 have forward-facing projections 327,527, and the set of arms 323*b*, 523*b* located farthest from the base 302,502 have rearward-facing projections 327,527. Additionally, the arms 123 are preferably slightly offset with respect to each other in the direction of such protrusion, to allow ample room for the arms 123 to flex. For example, as shown in FIGS. 7 and 9, the arms 123*a* of the first set are offset to one side of the trunk 116, and the arms 123*b* of the second set are offset to the opposite side of the trunk 116.

In an alternate embodiment, the arms 123 may be connected to the fingers 122, rather than existing as a separate structure. Thus, the fingers 122 may contain flexible structure that is adapted to contact both sets of interior walls 37*a*,39*a* of the muntin bar end 38 to stabilize and support the muntin bar end 38. The arrangements of flexible trunk members 121, such as the flexible arms 123 and flexible fingers 122 can be considered a means for bracing the two pairs of opposed inner walls 37*a*,39*a* of the muntin bar end 38.

The preferred base 102 is illustrated in FIGS. 6-10 and includes a bar stop 108 and a plug 109 positioned proximate the bar support 106. The bar stop 108 is designed to abut the muntin bar end 38 when the bar support 106 is inserted therein, in order to prevent the remainder of the base 102 from entering the muntin bar end 38. It is preferably wider than the widest portion of the bar support 106. The plug 109 connects the base 102 to the bar support 106 and is also adapted to be inserted into the muntin bar end 38.

The preferred base 102 has a central block 111 and also has a mount structure 104 that includes a means for connecting the base 102 to a variety of different spacer frames 30. The mount structure 104 preferably includes a flexible latch structure 110 attached to the central block 111, and is generally considered to be connected to the base 102 of the muntin clip 100. The flexible latch structure 110 is adapted to flex inward when the base 102 is inserted into the spacer frame 30, and to connect the muntin clip 100 to the spacer frame 30, as described below. The flexible latch structure 110 preferably includes two flexible members 112 that engage the spacer frame 30, one extending from each side of the central block 111. The flexible members 112 preferably are attached at the bottom of the central block 111 and curve or angle upward and outward, forming a U-shape or a V-shape when viewed from the side (FIG. 9). This shape facilitates insertion of the base 102 into the spacer frame 30. In other embodiments, the flexible members 112 may be attached at another point on the base 102. For example, in one embodiment the flexible members 112 are attached proximate the top of the central block 111 and curve downward and then back upward, so that each flexible member forms a U-shape or a V-shape. It is understood that the flexible members 112 are flexible with respect to both the base 102 and the bar support 106, and are flexible in either direction, i.e., inwardly and outwardly from the base 102 and bar support 106. Additionally, the flexible members 112 are able to engage the spacer frame, preferably by latching onto the shoulders 60 of the spacer frame 30. As illustrated in FIGS. 6-10, the flexible member 112 preferably has a single flexible stem 115 connecting the cross-member 113 and resilient tabs 114 to the central block 111. In other embodiments, the flexible member 112 may have more than one flexible stem 115. It is understood that the benefits of the invention can be observed with a single flexible member 112, although a pair of flexible members 112 is preferred. The flexible members 112 preferably each have two resilient tabs 114 thereon, as well as a cross-member 113 extending across the free end 112*a* of the flexible member 112.

The preferred resilient tabs 114 are best illustrated in FIGS. 6-10, and are the preferred mechanism for latching of the flexible member 112 to the spacer frame 30. In the preferred embodiment, each flexible member 112 has a pair of resilient tabs 114 attached at the free end 112*a* of the flexible member 112 that face along the direction of the cross-member 113 and the fingers 122, as best illustrated in FIGS. 8 and 10. Each tab 114 preferably depends from the flexible member 112, but has an upturned portion 114*a* angling outwardly and back toward the cross-member 113. This orientation allows the tabs 114 to latch onto the sides of the notches 62 in the shoulder 60 of the spacer frame 30, as shown in FIGS. 12, 29, 31, 33, 35, and 37. Additionally, as shown in FIGS. 8 and 9, the upturned portion 114*a* of each tab 114 is angled, which serves at least a dual function. First, the angling permits the tab 114 to slide more easily into the slot 62 when the base 102 is inserted into the spacer frame 30, as illustrated in FIGS. 28, 30, 32, 34, and 36. Second, the upturned portion 114*a* also angles so that the tab 114 becomes wider as the upturned portion 114*a* approaches the cross-member, allowing for a larger latching surface, which in turn allows the flexible member 112 to latch onto a wider variety of spacer frames 30. Generally, the tabs 114 are considered to be attached to the flexible member 112. The resilient tabs 114 in the preferred embodiment depend from the cross-member 113, but may be differently positioned on the base 102. Further, a portion of the cross-member 113 preferably hangs over the upturned portion 114*a* of each tab 114 to create a more secure latching action. However, in some embodiments, the tabs 114 hang freely from the outer edges of the flexible member 112 with no cross-member 113 extending over the top.

Additionally, the tabs 114 may be configured or oriented differently. As shown in one preferred embodiment, the tabs 114 are preferably oriented to face in a direction transverse to the flexible member 112, and along the direction of the cross-member 113. In other words, the resilient tabs 114 face generally in the same direction as the flexible fingers 122. Further, each pair of tabs 114 on a particular flexible member 112 preferably face away from each other. However, the tabs 114 may be turned 90 degrees to face more outwardly, in the direction of flexing of the flexible members 112. Thus, the resilient tabs 114 would face in the same direction as the projections 127. Still further, the tabs 114 may face inwardly along the direction of the cross-member, so that the tabs 114 of each pair face each other, as opposed to facing outwardly and away from each other (FIG. 10). The latching structure 110 may contain a greater or smaller number of tabs 114, and the tabs 114 may be shaped differently. For example, the angled, upturned portion 114*a* may not be necessary in all embodiments. In other embodiments, the latch structure 110 may have no resilient tabs 114, and may latch onto the spacer frame 30 by a different method. For example, the flexible member 112 could cooperate with a shoulder portion 67 (FIG. 4) of the spacer frame 30 that is positioned between the notches 62. The flexible member 112 may also include a tab that engages an underside of the shoulder portion 67.

As shown in FIGS. 6-10, the tabs 114 and cross-members 113 are positioned at a distance from the bar support 106 and the base 102, due to the outwardly-extending nature of the flexible members 112. Also, due to the flexible nature of the flexible members 112, the tabs 114 and the cross-members 113 are moveable with respect to both the bar support 106 and the central block 111 of the base 102. Further, because both the tabs 114 and the flexible arms 112 can flex or pivot independently and in separate directions, the tabs 114 are considered to be flexible and moveable in at least two directions.

To assemble a sash window 12 incorporating a muntin grid 34 utilizing a clip 100 and muntin bar 36 according to the present invention, the spacer assembly 28 is formed according to any method currently known in the art. Then the muntin grid 34 is assembled by joining a plurality of muntin bars 36 to one another to form a grid shape. Typically, the grid is generally rectangular, but it is understood that the grid may take other shapes as well. Then a muntin clip 100 is attached to the grid 34 at each muntin bar end 38 located near a periphery of the overall grid 34.

Figure 3:
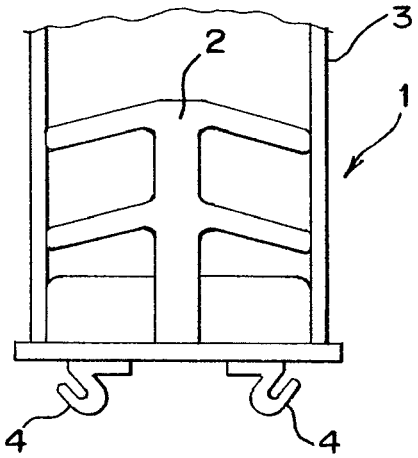
FIG.3 PRIOR ART
FIG. 3 is a side elevation view of a prior art muntin clip.
Figure 11:
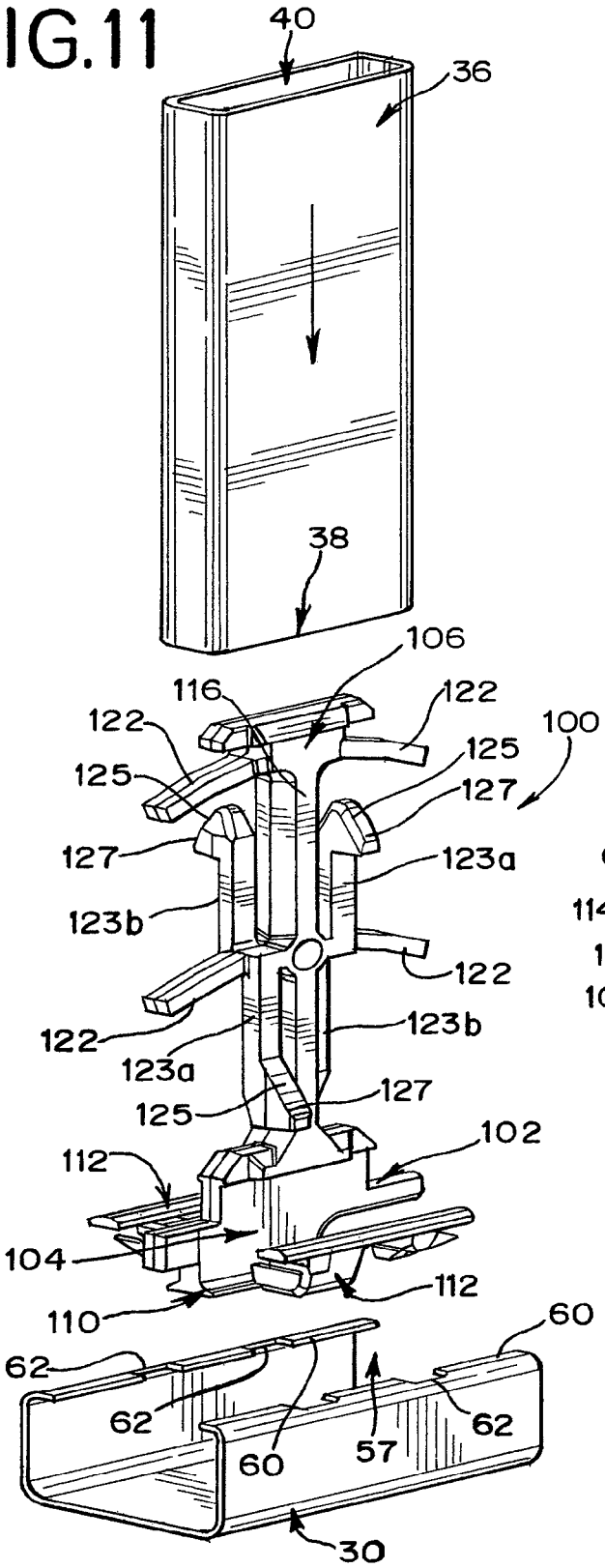
FIG. 11 is an exploded perspective view showing the assembly of the muntin clip of FIG. 6 and a muntin bar end (shown partially) and a spacer frame (shown partially) according to the present invention.
Figure 12:
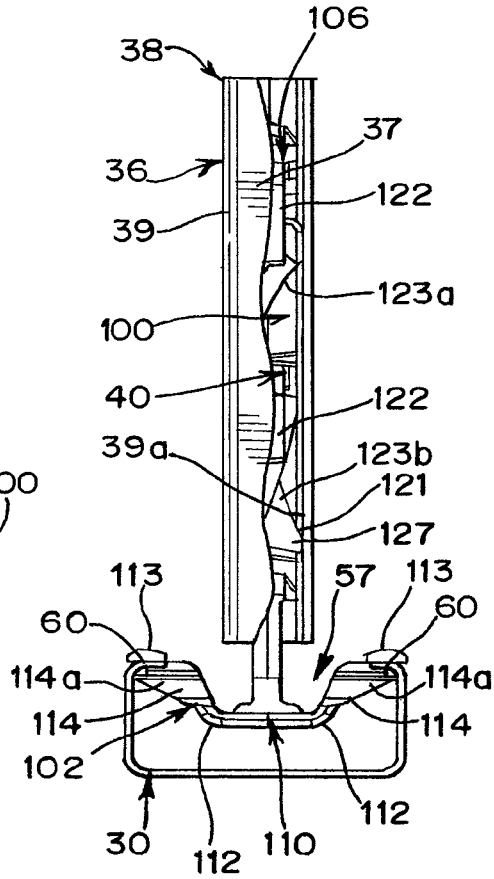
FIG. 12 is a broken side view showing the connection between the muntin clip, the muntin bar end (shown partially) and the spacer frame (shown partially) of FIG. 11.

FIG. 11 illustrates the way in which the clip 100 is connected to the muntin bar end 38, indicated by the arrows. To attach the clip 100 to the muntin bar end 38, the bar support 106 is inserted into the generally hollow muntin bar end 38. The bar support 106 will be typically inserted into the muntin bar end 38 until the entire plug 109 is substantially located within the end 38. When the bar support 106 is inserted into the muntin bar end 38, the fingers 122 contact one pair of the opposed interior walls 37*a* of the muntin bar end 38 and substantially deflect, flexing inwardly and downwardly, in response to the contact. Likewise, and as shown in FIG. 12, the projections 123 contact the other pair of the opposed interior walls 39*a* of the muntin bar end 38. In response to this contact, the arms 123 substantially deflect, flexing inwardly. The downward angle of the fingers 122, as well as the beveled portions 125 near the projections 127, allow the bar support 106 to slide more easily into the muntin bar end 38. Thus, there is substantial deflection of the flexible fingers 122 and the flexible arms 124 providing an enhanced fit as opposed to the fit provided by prior art muntin clips such as shown in FIG. 3. The arms 123 and fingers 122 provide a firm connection with the muntin bar 36 that resists twisting or bending of the muntin bar 36, as described in greater detail below.

Figure 13:
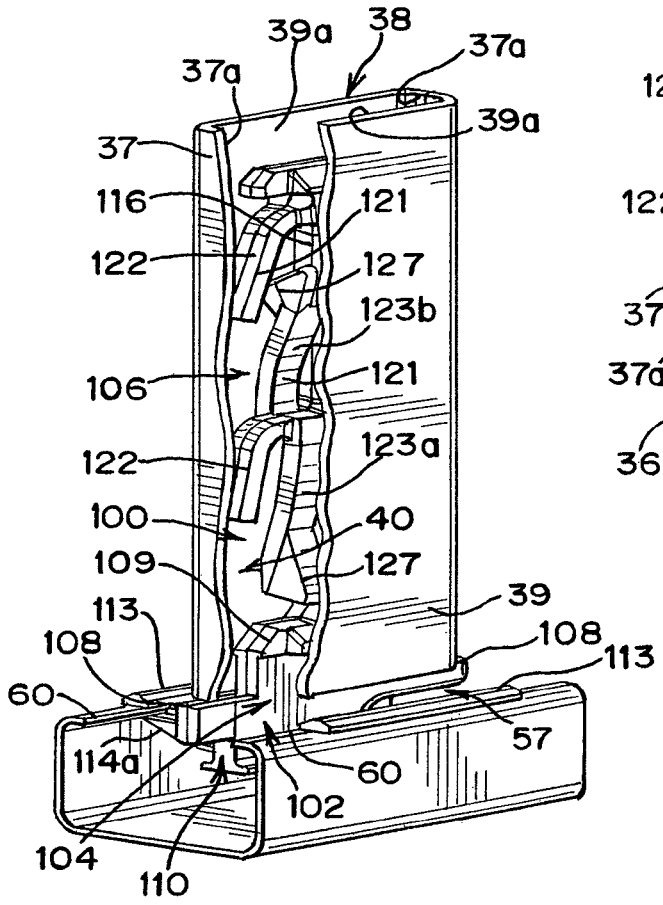
FIG. 13 is a broken perspective view of the muntin clip, the muntin bar end and the spacer frame of FIG. 12, the muntin bar end and spacer frame shown partially.

FIG. 11 also illustrates the way in which the clip 100 is connected to the spacer frame 38, indicated by the arrows. Additionally, FIGS. 28, 30, 32, 34, and 36 illustrate the base 102 being inserted into a variety of different spacer frames 30*a*, 30*b*, 30*c*, 30*d*, 30*e* and FIGS. 29, 31, 33, 35, and 37 illustrate the base 102 after connection to these spacer frames 30*a*, 30*b*, 30*c*, 30*d*, 30*e*. To attach the clip 100 to the muntin bar end 38, the base is inserted into the opening 57 in the spacer frame 30. The shoulders 60 contact the flexible members 112 of the latch structure 110 and cause the flexible members 112 to flex inwardly, shown in 28, 30, and 32. As the base 102 is pushed downward, the flexible members 112 continue to flex until the resilient tabs 114 slip completely into the notches 62 and engage the shoulders 60 of the spacer frame 30, shown in FIGS. 29, 31, 33, 35, and 37. At that point, the flexible members 112 generally snap slightly back outward. Preferably, the resilient tabs 114 also flex inward slightly as the base 102 is inserted, until the point that the tabs 114 clear the shoulder 60 of the spacer frame 30. It is understood then that the resilient tabs 114 engage the underside surfaces of the shoulder 60 proximate the notches 62. The cross members 113 contact the top of the shoulders 60 to ensure that the base 102 cannot be inserted too far into the spacer frame 30, as shown in FIGS. 12-13. Alternately, the latch structure 110 may have no resilient tabs 114, and may have a different structure to latch onto or otherwise engage the spacer frame 30. Particularly, the latch structure 110 may have no component that slips into notches 62 in the spacer frame 30, and may simply latch onto the shoulders 60 by other interference or latching structures.

Figure 38:
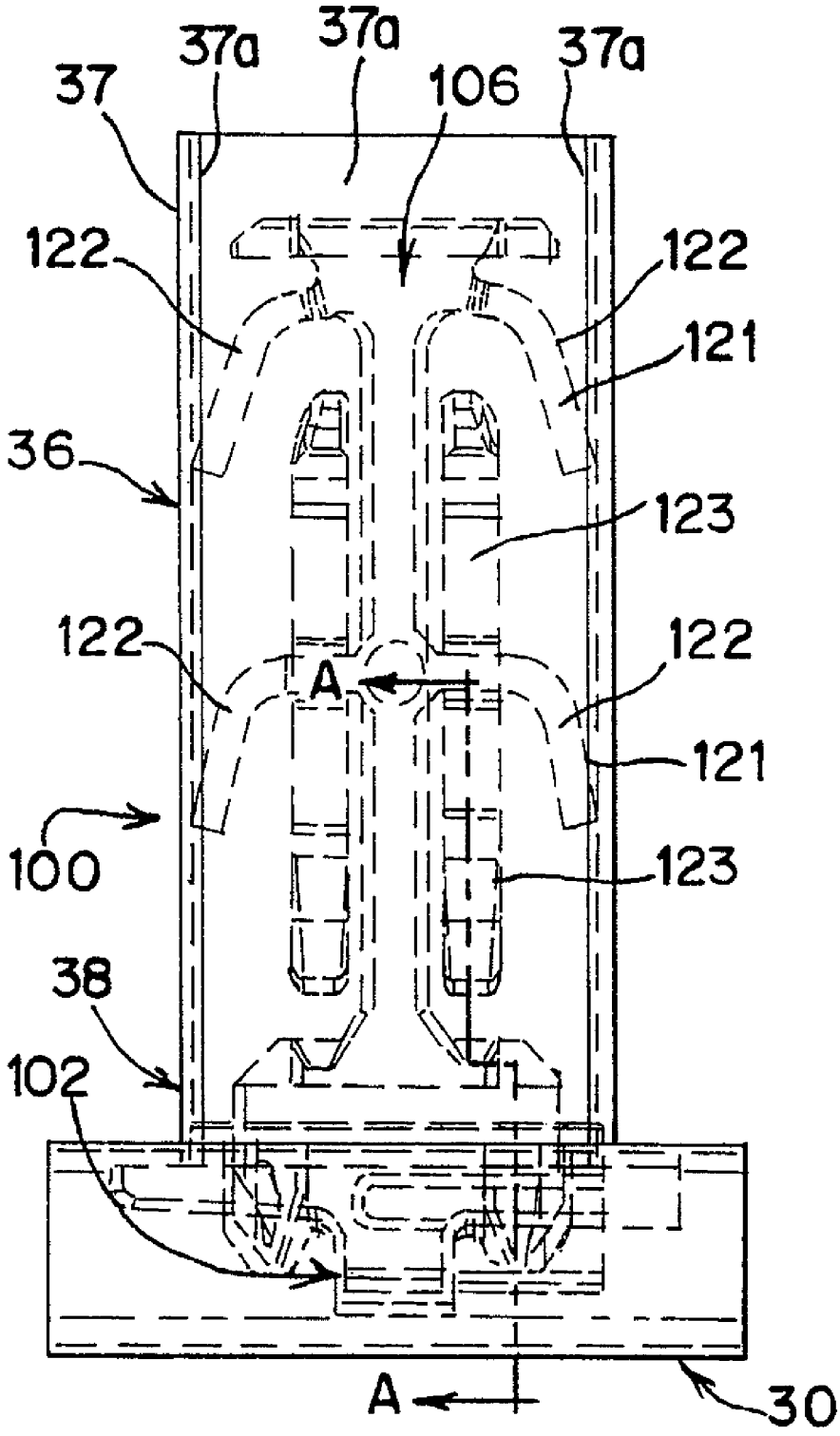
FIG. 38 is a front elevation view of a muntin clip according to the present invention connected to a muntin bar and a spacer frame.

FIGS. 12-13 and 38 illustrate the assembled muntin bar end 38, muntin clip 100, and spacer frame 30. The fingers 122 are in contact with the interior side walls 37*a* and are substantially deflected or deformed downward and inward in response to such contact. Likewise, the arms 123 are in contact with the interior lateral walls 39*a*, and are substantially deflected or deformed inward in response to such contact. The resilient nature of the fingers 122 and the arms 123 results in pressure being exerted on the interior side walls 37*a*,39*a* of the muntin bar end 38 by the fingers and arms 123, securing the muntin bar end 38 to the clip 100 and stabilizing the muntin bar 36. Further, the pressure exerted on the lateral walls 39*a* by the flexible arms 123 resists torque applied to the muntin bar 36. Two of the arms 123 would tend to oppose rotation of the muntin bar end 38 in one direction while the other two arms 123 would tend to oppose rotation of the muntin bar end 38 in an opposed direction of rotation. In other words, the arms 123 provide four-point opposed contact with the inner lateral walls 39*a* of the muntin bar end. Additionally, when the base 102 is inserted into the spacer frame, portions of the shoulders 60 of the spacer frame are positioned between the resilient tabs 114 and the cross-members 113. The resilient tabs 114 are preferably each received in one of the notches 62 on the shoulders 60 of the spacer frame 30. This arrangement allows the base 102 to latch onto the spacer frame and allows the clip 100 to hold, support, position, and stabilize the muntin bar 36. Also, the arrangement of the tabs 114 and the notches 62 prevents the clip 100 from moving or sliding on the spacer frame. However, other structures can be employed to prevent such movement in place of the tabs 114 and notches 62.

Figure 14:
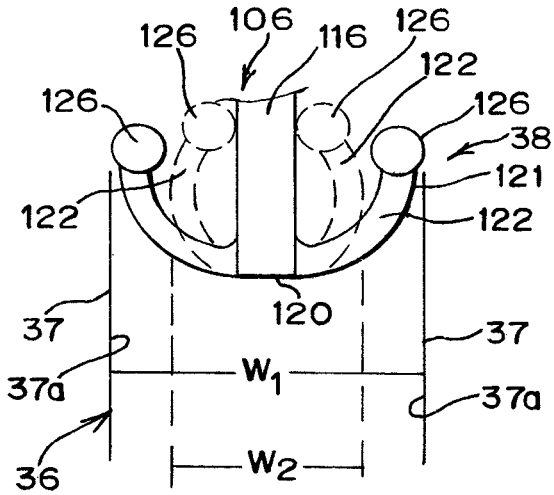
FIG. 14 is a partial plan view of a muntin clip according to the present invention being inserted into a muntin bar end.

It can be seen that the flexible nature of the fingers 122 will function to maintain the bar 36 centered about the bar support 106 specifically and the overall clip 100, generally. The flexible nature of the fingers 122 also permits the clip 100 to accommodate muntin bar ends 38 having any width W within a wide range of widths. So long as the muntin bar end 38 has a sufficient width W to permit the bar support 106 to be inserted into the end 38, and so long as the free ends 126 are able to engage the opposed side walls 37, the clip 100 may be used with that particular muntin bar 36. The width W may range from the distance W1 between free ends 126 of the fingers 122 in an unflexed position and the distance W2 between the free ends 126 in a fully flexed position as schematically represented in FIG. 14. The width of the outermost edges of the arms 123 may also limit the minimum size of suitable muntin bar ends 38. In this way, the overall bar support structure 106 including the flexible fingers 122 permits the clip 100 to accommodate a variety of muntin bar ends 38, as previously stated. Similarly, the resilient nature of the arms 123 permits the clip 100 to accommodate muntin bar ends 38 having a variety of thicknesses T. Accordingly, and unlike with previously known clips, one clip 100 according to the present invention may be used with any number of muntin bar 36 designs.

Figure 27:
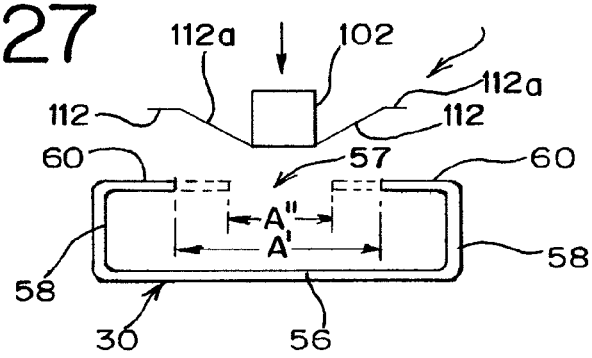
FIG. 27 is a schematic view showing a base of the muntin clip according to the present invention being inserted into a spacer frame
Figure 28:
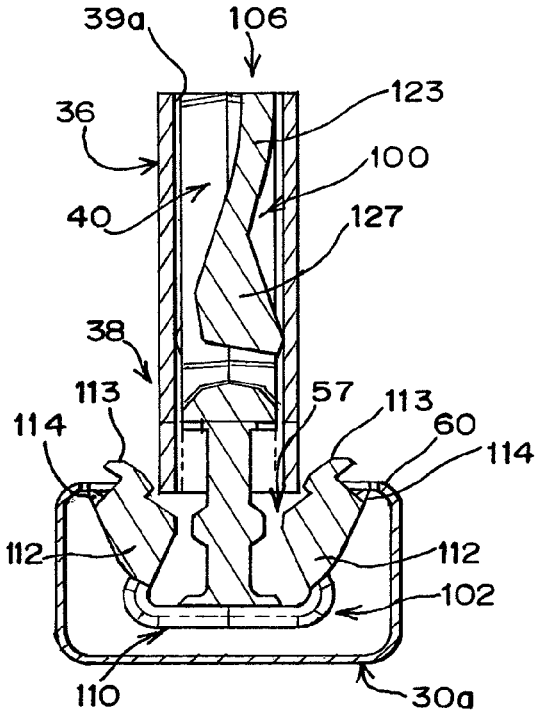
FIG. 28 is a partial cross sectional view taken along lines A-A of FIG. 38, showing a muntin clip according to the present invention connected to a muntin bar and being pushed into a spacer frame having an opening of near minimum width.
Figure 29:
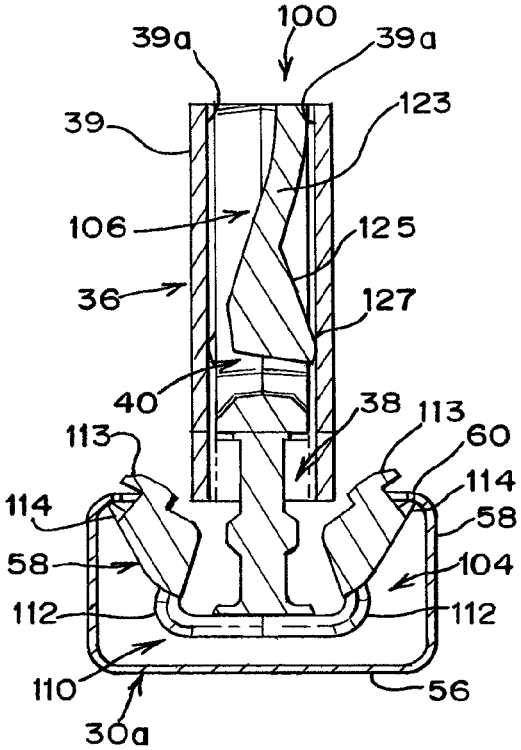
FIG. 29 is a partial cross sectional view taken along lines A-A of FIG. 38, showing the muntin clip, muntin bar, and spacer frame of FIG. 28 in an assembled position.
Figure 30:
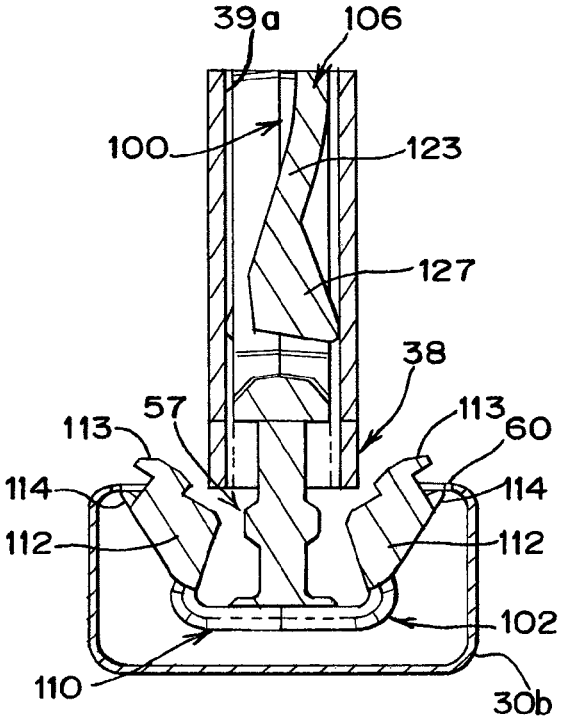
FIG. 30 is a partial cross sectional view taken along lines A-A of FIG. 38, showing a muntin clip according to the present invention connected to a muntin bar and being pushed into a spacer frame having an opening of small to intermediate width.
Figure 31:
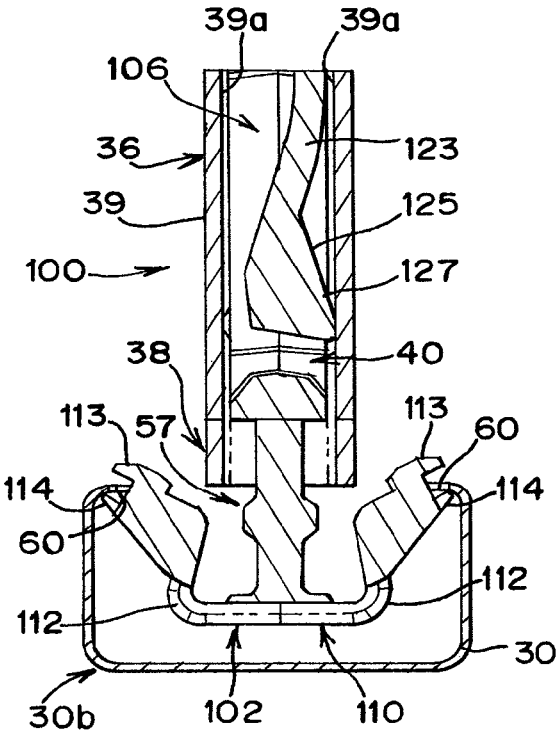
FIG. 31 is a partial cross sectional view taken along lines A-A of FIG. 38, showing the muntin clip, muntin bar, and spacer frame of FIG. 30 in an assembled position.
Figure 32:
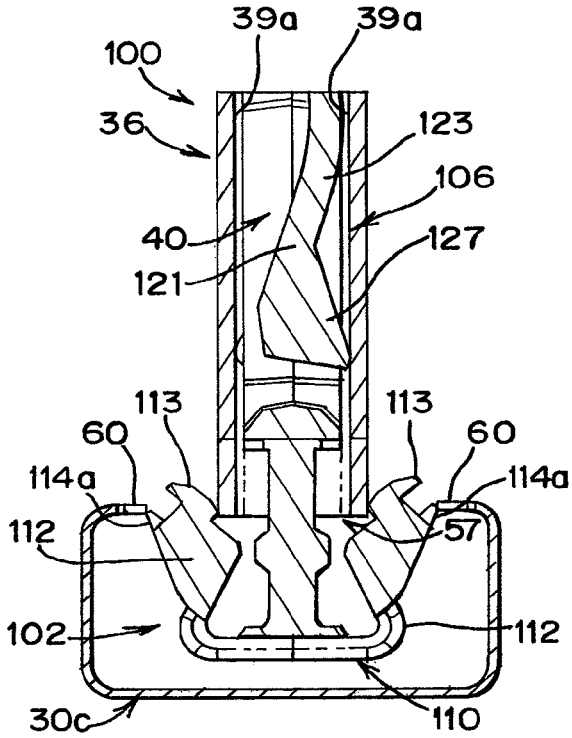
FIG. 32 is a partial cross sectional view taken along lines A-A of FIG. 38, showing a muntin clip according to the present invention connected to a muntin bar and being pushed into a spacer frame having an opening of intermediate width.
Figure 33:
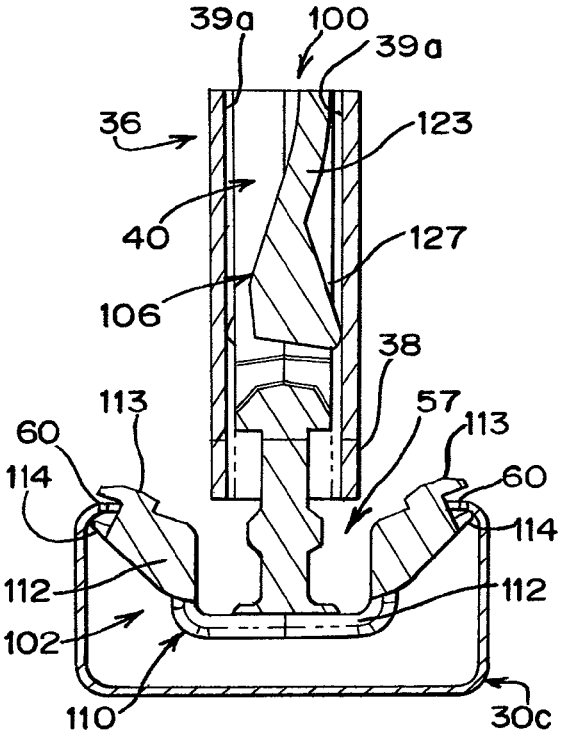
FIG. 33 is a partial cross sectional view taken along lines A-A of FIG. 38, showing the muntin clip, muntin bar, and spacer frame of FIG. 32 in an assembled position.
Figure 34:
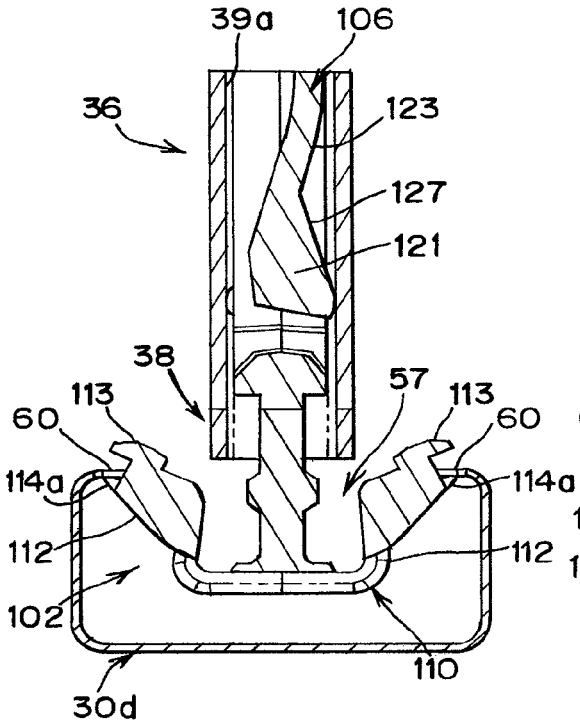
FIG. 34 is a cross sectional view taken along lines A-A of FIG. 38, showing a muntin clip according to the present invention connected to a muntin bar and being pushed into a spacer frame having an opening of intermediate to large width.
Figure 35:
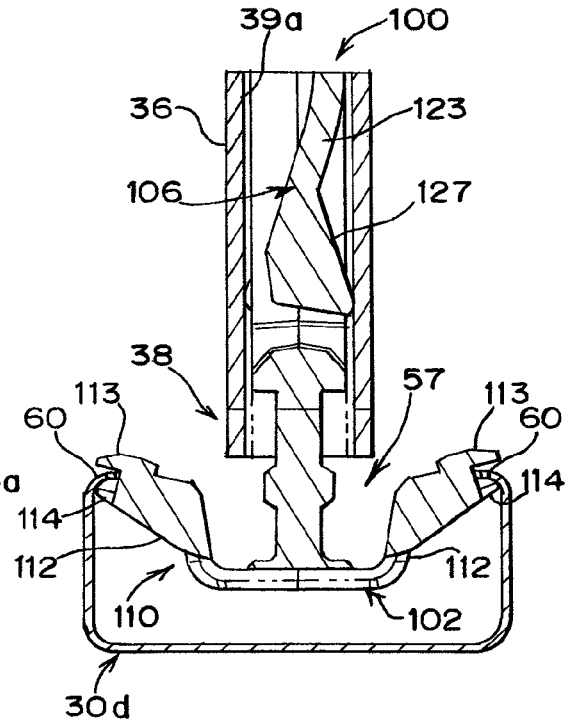
FIG. 35 is a cross sectional view taken along lines A-A of FIG. 38, showing the muntin clip, muntin bar, and spacer frame of FIG. 34 in an assembled position.
Figure 36:
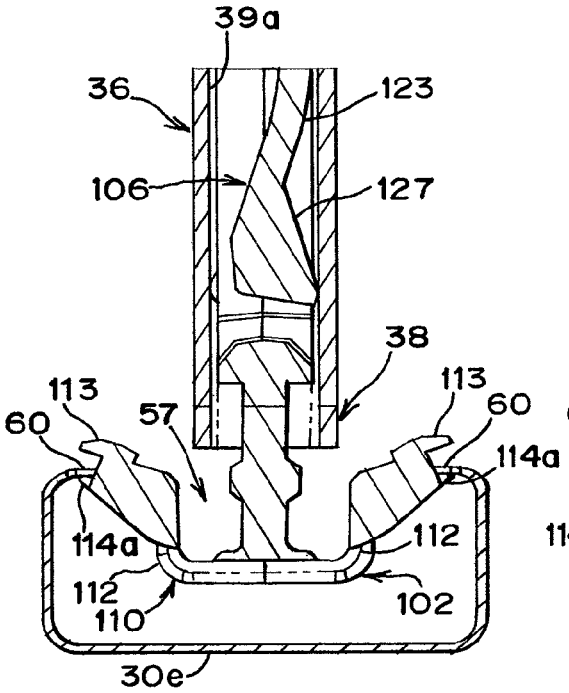
FIG. 36 is a cross sectional view taken along lines A-A of FIG. 38, showing a muntin clip according to the present invention connected to a muntin bar and being pushed into a spacer frame having an opening of nearly maximum width.
Figure 37:
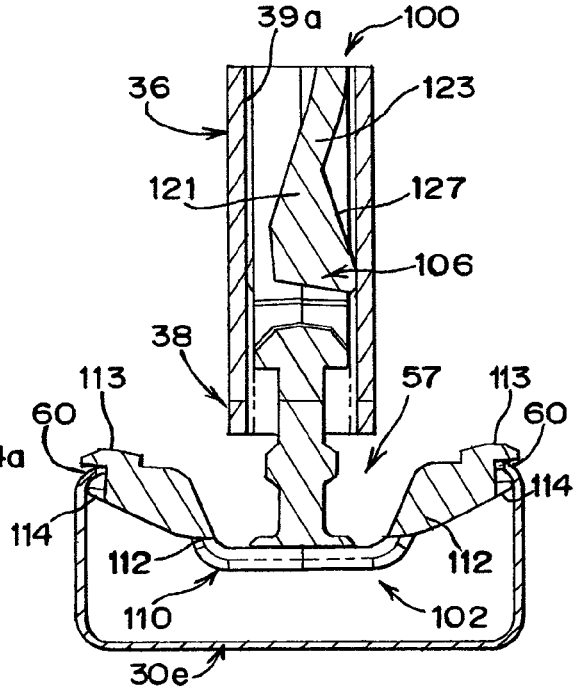
FIG. 37 is a cross sectional view taken along lines A-A of FIG. 38, showing the muntin clip, muntin bar, and spacer frame of FIG. 36 in an assembled position.

Similarly, the latch structure or mechanism 110 functions to maintain the bar 36 in position on the spacer frame 30, and the flexible nature of the latch structure 110 permits the clip 100 to accommodate spacer frames with openings 57 of any width A within a range of widths. So long as the shoulders 60 of the spacer frame have a sufficient distance A between them to permit the base 102 to be inserted into the spacer frame 30, and so long as the ends of the latch mechanism 110 are able to engage the shoulders 60, the clip 100 may be used with that particular spacer frame 30. The width A may range from the distance A' between the ends of the flexible members 112 in an unflexed position and the distance A" between the ends of the flexible members in a fully flexed position, as shown in FIG. 27. FIGS. 28 and 29 illustrate the insertion of the base 102 into a spacer frame 30*a* having an opening of nearly minimum width A. The flexible members 112 are deflected a great deal in FIG. 28, and have little room to flex farther inward. It is understood that a separate stop structure could be incorporated into the base 102 to prevent flexion of the flexible members 112 as desired. FIGS. 30 and 31 illustrate the insertion of the base 102 into a spacer frame 30*b* having an opening of small to intermediate width A. FIGS. 32 and 33 illustrate the insertion of the base 102 into a spacer frame 30*c* having an opening of intermediate width A. FIGS. 34 and 35 illustrate the insertion of the base 102 into a spacer frame 30*d* having an opening of intermediate to large width A. FIGS. 36 and 37 illustrate the insertion of the base into a spacer frame 30*e* having an opening of nearly maximum width A. The flexible members 112 are nearly in the unflexed position in FIG. 37, representing nearly the largest width A over which the latch structure 110 can span.

Accordingly, and unlike with previously known clips, one clip 100 according to the present invention may be used with any number of spacer frame 30 designs. Also, a plurality of similarly structured clips 100 may be used to cover an even broader range of spacer frame 30 designs. In one preferred embodiment, the muntin clip 100 can be used with spacer frames having a lateral wall dimension C from generally 0.2 inches to 0.9 inches. It is further understood that spacer frames 30 having a varying width A, such as if the length of the shoulders 60 changes. Generally, it is understood that the clip 100 can be constructed to be used in spacer frames 30 of practically infinite sizes. As such, each clip 100 can be used with a plurality of different sized spacer frames 30 and muntin bars 36 because of the flexible support or latching structure employed.

Generally, the muntin grid 34 is assembled by first attaching a muntin clip 100 to each muntin bar end 38, and then attaching the overall muntin grid 34 to the spacer frame 30. This is accomplished by orienting the overall grid 34 such that each muntin clip 100 attached to the grid 34 is located near one set of two notch pairs 64. The clips 100 are then inserted into the spacer frame 30. It is understood that in certain embodiments and modifications, this order could be reversed. Once each of the muntin clips 100 of each muntin bar end 38 is attached to the spacer frame 30 in this manner, the overall grid 34 is positioned within the plane defined by the spacer frame 30. The panes 24, 26 may be assembled to the spacer frame assembly 28, which in turn may be installed into a sash window 12 in any known manner.

Figures 16, 17, 18:
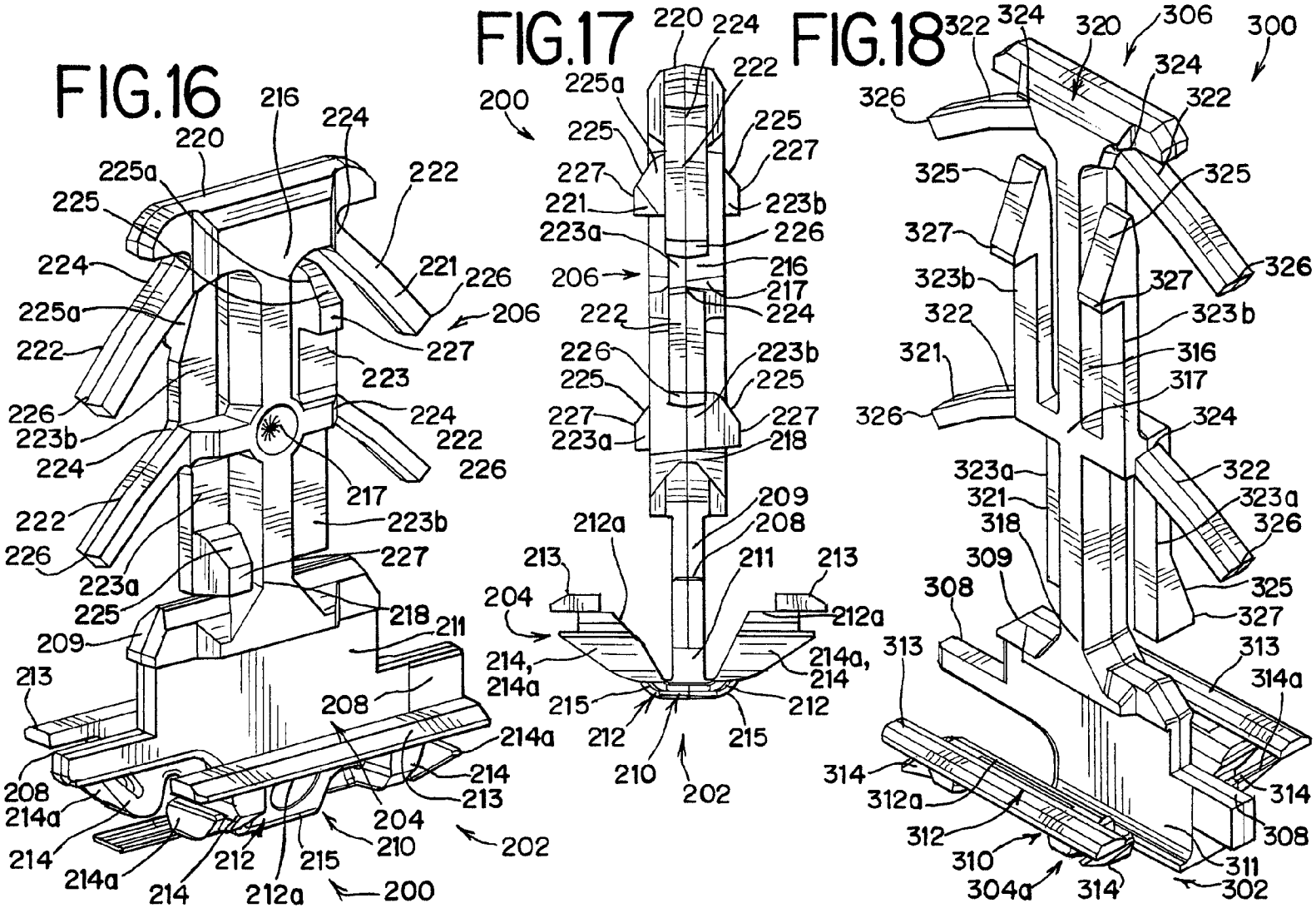
FIG. 16 is a perspective view of a second embodiment of a muntin clip according to the present invention.
FIG. 17 is a side view of the muntin clip of FIG. 16.
FIG. 18 is a perspective view of a third embodiment of a muntin clip according to the present invention.

A second preferred embodiment of a muntin clip according to the present invention is shown in FIGS. 16-17 and generally designated with the reference numeral 200. Each of the above described features, benefits, assembly and operation of the clip 100 shown in FIGS. 6-10 is similarly applicable to the clip 200 of FIGS. 16-17, and is referred to using reference series 2xx, rather than 1xx, which is used to reference the first embodiment shown in FIGS. 6-10. A difference between the clip 200 in FIGS. 16-17 and the clip 100 shown in FIGS. 6-10 is that the clip 200 of the second embodiment is shorter in length and has slightly greater thickness in the trunk 216, fingers 222, arms 223, and flexible members 212 than the clip 100 of the first embodiment. Additionally, two of the arms 223 of the clip 200 of the second embodiment have angled portions 225 beneath the adjacent fingers 222 to allow the fingers 222 a greater freedom of movement before they contact the arms 223. The central hub 217 is also a more pronounced structure.

Figures 19, 20, 21:
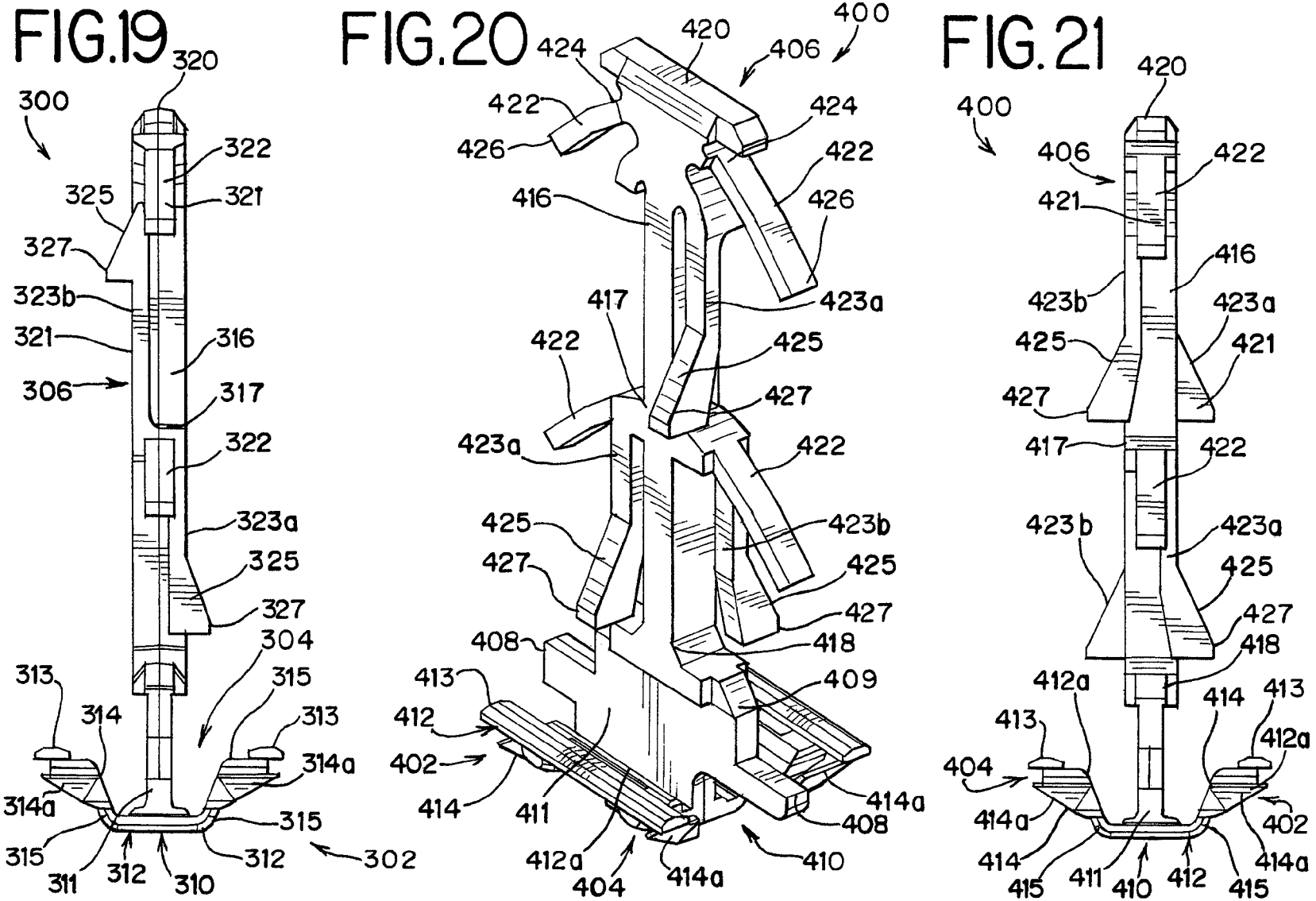
FIG. 19 is a side view of the muntin clip of FIG. 18.
FIG. 20 is a perspective view of a fourth embodiment of a muntin clip according to the present invention.
FIG. 21 is a side view of the muntin clip of FIG. 20.

A third preferred embodiment of a muntin clip according to the present invention is shown in FIGS. 18-19 and generally designated with the reference numeral 300. Each of the above described features, benefits, assembly and operation of the clip 100 shown in FIGS. 6-10 is applicable to the clip 300 of FIGS. 18-19, and is referred to using reference series 3xx, rather than 1xx. A difference between the clip 300 and the clip 100 shown in FIGS. 6-10 is in the arrangement of the arms 323. In the third clip embodiment 300, as described above, the flexible arms 323 of each set are located adjacent each other, rather than cater-corner. The set of arms 323*a* located closest to the base 302 have forward-facing projections 327, and the set of arms 323*b* located farthest from the base 302 have rearward-facing projections 327. Other components are substantially identical. It is understood when the clip 300 is inserted into the muntin bar 36, the arms 323*a* having the forward-facing projections 327 engage one wall of the muntin bar 36, and the arms 323*b* having the rearward-facing projections 327 engage an opposite wall of the muntin bar 36 as can be understood from the previous description above. Thus, one set of arms 323*a* provide a force in one direction and one set of arms provide a force in another direction.

A fourth preferred embodiment of a muntin clip according to the present invention is shown in FIGS. 20-21 and generally designated with the reference numeral 400. Each of the above described features, benefits, assembly and operation of the clip 100 shown in FIGS. 6-10 is similarly applicable to the clip 400 of FIGS. 20-21, and is referred to using reference series 4xx, rather than 1xx. A difference between the clip 400 and the clip 100 shown in FIGS. 6-10 is in the arrangement of the arms 423. In the fourth clip embodiment 400, two of the arms 423 are attached to the trunk 416 proximate the distal end 420 of the trunk 416, thus depending downwardly, and two of the arms 423 are attached to the central hub 417, also depending downwardly. In contrast, in the first embodiment 100, all four arms 123 are attached to the trunk 116 proximate the central hub 117. The projections 427 are also arranged on sets of the arms 423 to provide opposing forces. Other components are substantially identical.

Figure 22:
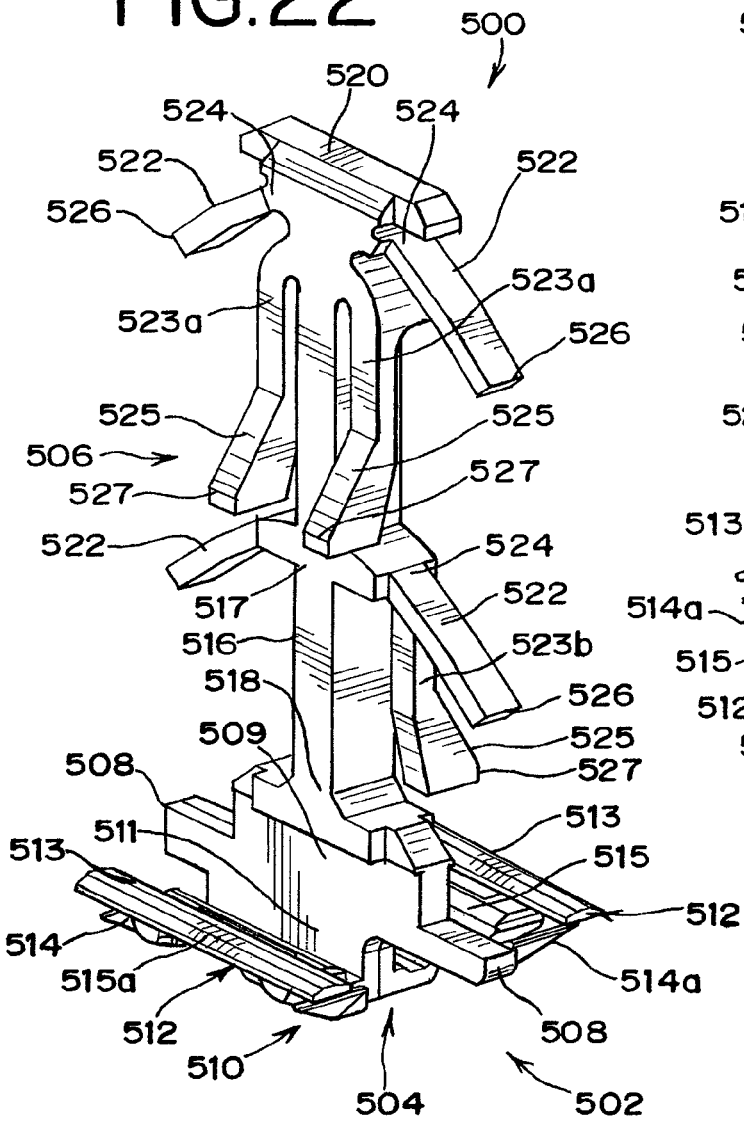
FIG. 22 is a perspective view of a fifth embodiment of a muntin clip according to the present invention.
Figure 23:
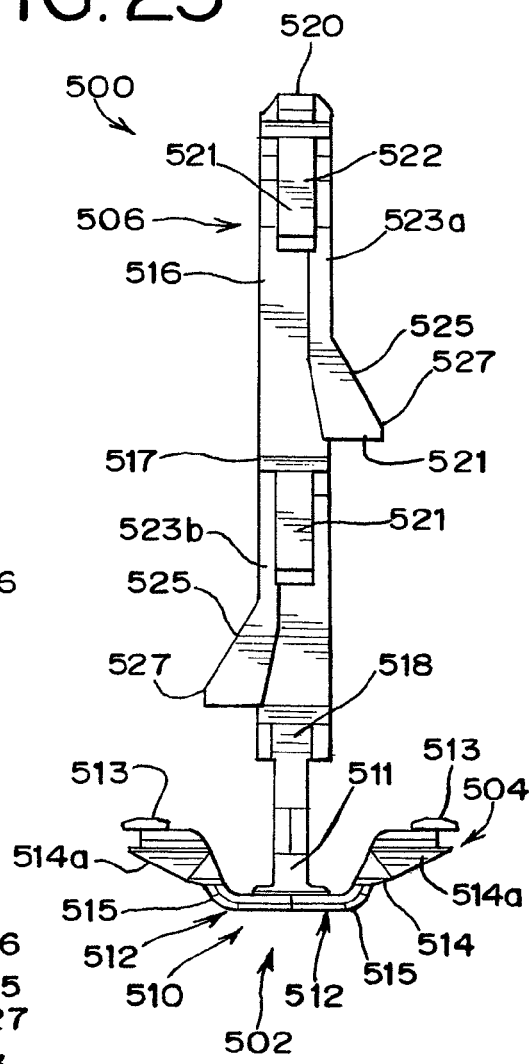
FIG. 23 is a side view of the muntin clip of FIG. 22.

A fifth preferred embodiment of a muntin clip according to the present invention is shown in FIGS. 22-23 and generally designated with the reference numeral 500. Each of the above described features, benefits, assembly and operation of the clip 100 shown in FIGS. 6-10 are applicable to the clip 500 of FIGS. 22-23, and is referred to using reference series 5xx, rather than 1xx. A differences between the clip 500 and the clip 100 shown in FIGS. 6-10 is in the arrangement of the arms 523. In the fifth clip embodiment 500, two of the arms 523 are attached to the trunk 516 proximate the distal end 520 of the trunk 516, and depend downwardly, and two of the arms 523 are attached to the central hub 517 and depend downwardly, similarly to the fourth clip embodiment 400 described above. Additionally, in the fifth clip embodiment 500, as described above, the arms 523 of each set are located adjacent each other, rather than cater-corner. The set of arms 523*a* located closest to the base 502 have forward-facing projections 527, and the set of arms 523*b* located farthest from the base 502 have rearward-facing projections 527. The projections 527 of the sets of arms 523 provide opposing forces. Other components are substantially identical.

Figures 24, 25, 26:
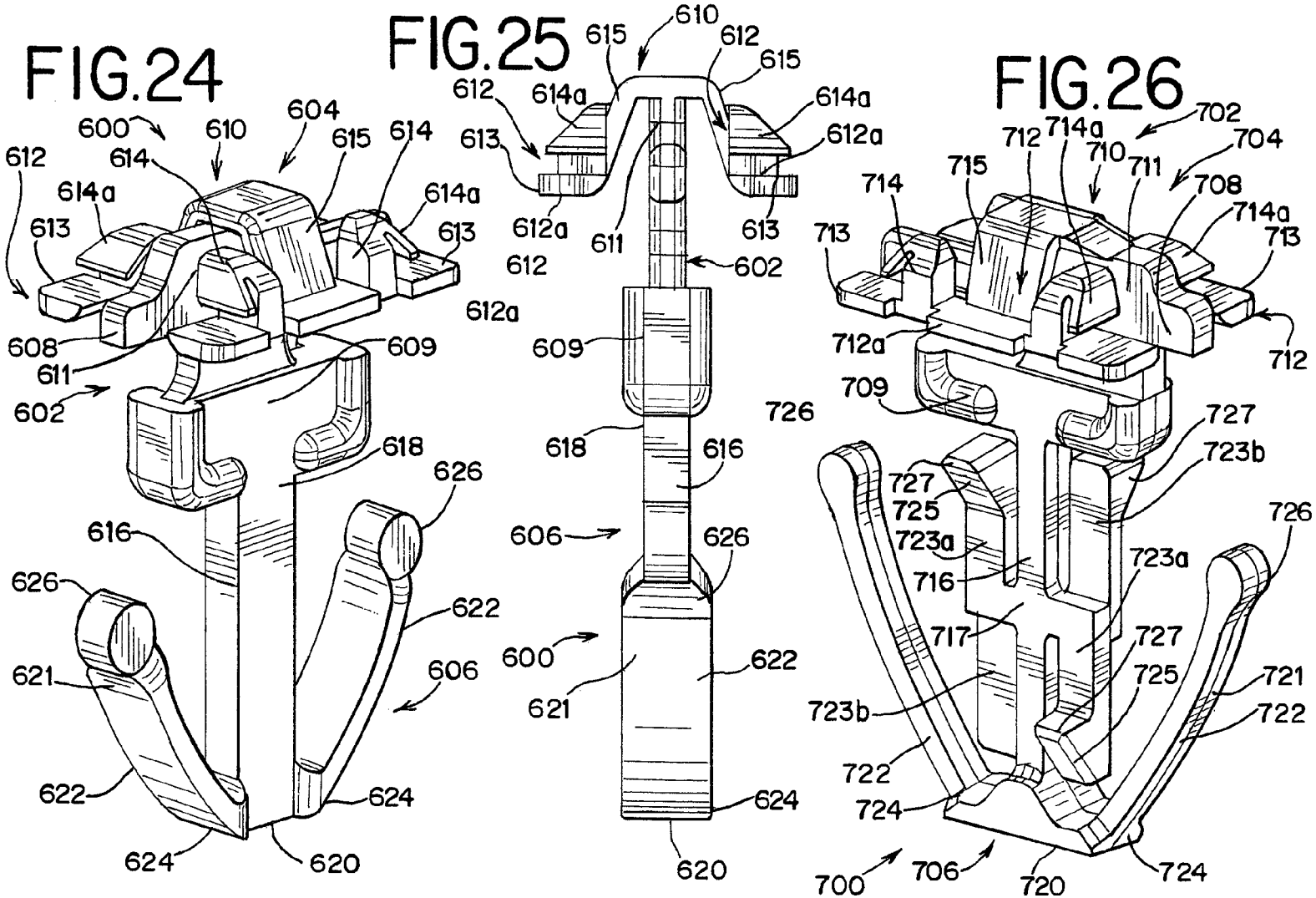
FIG. 24 is a perspective view of a sixth embodiment of a muntin clip according to the present invention.
FIG. 25 is a side view of the muntin clip of FIG. 24.
FIG. 26 is a perspective view of a seventh embodiment of a muntin clip according to the present invention.

Another embodiment of a muntin clip according to the present invention is shown in FIGS. 24-25 and generally designated with the reference numeral 600. Most of the above described features, benefits, assembly and operation of the clip 100 shown in FIGS. 6-10 are applicable to the clip 600 of FIGS. 24-25, and are referred to using reference series 6xx, rather than 1xx. A difference between the sixth clip embodiment 600 and the clip 100 shown in FIGS. 6-10 is that the bar support 606 of the clip 600 contains only two fingers 622, which are located proximate the distal end 620 of the trunk 616 and are angled farther downward than the fingers 122 of the first clip embodiment 100. Additionally, the fingers 622 have rounded ends 626, unlike the fingers 123 of the first embodiment 100. Further, the sixth clip embodiment 600 contains no flexible arms extending along the trunk 616 that project transversely to the trunk 616 and the fingers 622.

Still another embodiment of a muntin clip according to the present invention is shown in FIG. 26 and generally designated with the reference numeral 700. Most of the above described features, benefits, assembly and operation of the clip 100 shown in FIGS. 6-10 are similarly present in the clip 700 of FIG. 26, and are referred to using reference series 7xx, rather than 1xx. Like the sixth clip embodiment 600, a difference between the seventh clip embodiment 700 and the clip 100 shown in FIGS. 6-10 is that the bar support 706 of the clip 700 contains only two fingers 722, which are located proximate the distal end 720 of the trunk 716 and are angled farther downward than the fingers 122 of the first clip embodiment 100. Additionally, the fingers 722 have rounded ends 726, like the fingers 622 of the sixth embodiment 600, but unlike the fingers 123 of the first embodiment 100. However, unlike the sixth embodiment 600, the seventh clip embodiment contains flexible arms 723 projecting in the same cater-corner arrangement as the arms 123 of the first clip embodiment 100.

Each of the alternate embodiments of the clip 200, 300, 400, 500, 600, 700 is used and assembled with the muntin bar end 38 and spacer frame 30 in the manner described above with respect to the first clip embodiment 100.

The flexible components of the bar support of the muntin clips described above permit a single clip to be connected to any of a variety of different muntin bars having a variety of different dimensions and configurations. Similarly, the flexible latch structure of the base permits a single clip to be connected to any of a variety of different spacer frames having a variety of different dimensions and configurations, and having openings of a variety of different widths. Thus, with the muntin clips as described above, the number of differently-sized muntin clips can be drastically reduced. This reduces inventory costs, additional tooling costs, and other costs associated with having to manufacture and store a large number of differently sized muntin clips. In addition, the number of spacer frame assemblies can be reduced.

While the specific embodiments and various details thereof have been illustrated and described, numerous modifications come to mind without significantly departing from the spirit of the invention and the scope of protection is only limited by the following claims.

What is claimed is:

1. A muntin clip assembly adapted to be connected to a muntin bar end and a spacer frame, the assembly comprising:

a base member having a mounting structure adapted to be connected to the spacer frame; and a bar support extending from the base member and adapted to be connected to the muntin bar end, the bar support having a trunk, a first group of flexible members extending outwardly from the trunk, and a second group of flexible members attached to the trunk and extending in a direction substantially parallel to the trunk, wherein the second group of flexible members comprises a first flexible arm having a first projection thereon protruding in a first direction transverse to the trunk, a second flexible arm having a second projection thereon protruding in a second direction transverse to the trunk and opposite to the first direction, a third flexible arm having a third projection thereon protruding in the first direction, and a fourth flexible arm having a fourth projection thereon protruding the second direction.

2. The muntin clip assembly of claim 1, wherein the first flexible arm and the third flexible arm are located in a cater-corner arrangement about the trunk and the second flexible arm and the fourth flexible arm are located in a cater-corner arrangement about the trunk.

3. The muntin clip assembly of claim 1, wherein the trunk has a first end attached to the base, a second end distal from the base, and a central hub between the first and second ends, and the first, second, third, and fourth flexible arms are attached to the trunk proximate the central hub.

4. The muntin clip assembly of claim 3, wherein the first and second flexible arms extend in a direction substantially parallel to the trunk and toward the second end, and the third and fourth flexible arms extend in a direction substantially parallel to the trunk and toward the first end.

5. The muntin clip assembly of claim 3, wherein the first and third flexible arms extend in a direction substantially parallel to the trunk and toward the second end, and the second and fourth flexible arms extend in a direction substantially parallel to the trunk and toward the first end.

6. The muntin clip assembly of claim 1, wherein the trunk has a first end attached to the base, a second end distal from the base, and a central hub between the first and second ends, the first and second flexible arms are attached to the trunk proximate the second end, and the third and fourth flexible arms are attached to the trunk proximate the central hub.

7. A muntin clip assembly adapted to be connected to a spacer frame and a hollow muntin bar end, the muntin bar end having a first pair of opposed interior walls and a second pair of opposed interior walls, the assembly comprising:

a base member having a mounting structure adapted to be connected to the spacer frame; and a bar support extending from the base member and adapted to be inserted into the muntin bar end, the bar support having a trunk having opposed lateral sides and opposed front and rear sides, a first group of flexible members attached to the trunk and comprising at least one flexible finger extending outward from one lateral side of the trunk and at least another flexible finger extending outward from the other lateral side of the trunk, the first group of flexible members thereby being adapted to contact the first pair of opposed interior walls of the muntin bar end when the bar support is inserted into the muntin bar end, and a second group of flexible members attached to the trunk and comprising at least one flexible arm having at least a portion extending frontward beyond the front side of the trunk and at least another flexible arm having at least a portion extending rearward beyond the rear side of the trunk, the second group of flexible members thereby being adapted to contact the second pair of opposed interior walls of the muntin bar end when the bar support is inserted into the muntin bar end.

8. The muntin clip assembly of claim 7, wherein the first group of flexible members is adapted to flex inwardly in response to contacting the first pair of opposed interior walls and the second group of flexible members is adapted to flex inwardly in response to contacting the second pair of opposed interior walls.

9. A muntin clip assembly adapted to be connected to a spacer frame and a hollow muntin bar end, the muntin bar end having a first pair of opposed interior walls and a second pair of opposed interior walls, the assembly comprising:

a base member having a mounting structure adapted to be connected to the spacer frame; and a bar support adapted to be inserted into the muntin bar end, the bar support comprising:

a trunk extending from the base member and having a first end attached to the base, a second end distal from the base, and a central hub between the first and second ends, a first pair of flexible fingers extending outwardly from opposed sides of the trunk proximate the second end, and a second pair of flexible fingers extending outwardly from opposed sides of the trunk proximate the central hub, wherein the first pair of flexible fingers and the second pair of flexible fingers are adapted to contact the first pair of opposed interior walls of the muntin bar end when the bar support is inserted into the muntin bar a first flexible arm attached to the first side of the trunk and a second flexible arm attached to the second side of the trunk, the first and second flexible arms extending in a direction substantially parallel to the trunk and toward the first end, and a third flexible arm attached to the first side of the trunk and a fourth flexible arm attached to the second side of the trunk, the third and fourth flexible arms extending in a direction substantially parallel to the trunk and toward the second end, wherein each of the first, second, third, and fourth flexible fingers is adapted to contact one of the second pair of opposed interior walls of the muntin bar end when the bar support is inserted into the muntin bar end and to flex inwardly in response to such contact.

10. A muntin assembly adapted to be connected to a spacer frame, the assembly comprising:

a base member having a mounting structure adapted to be connected to the spacer frame;

a bar support extending from the base member and adapted to be connected to the muntin bar end, the bar support having a trunk, a first group of flexible members extending outwardly from the trunk, and a second group of flexible members attached to the trunk and extending in a direction substantially parallel to the trunk; and a muntin bar defining an opening and a first pair of opposed interior walls and a second pair of opposed interior walls, wherein the bar support is inserted into the opening, wherein the first group of flexible members deflect and engage the first pair of opposed interior walls, and wherein the second group of flexible members deflect and engage the second pair of opposed interior walls.

11. The muntin assembly of claim 10 wherein the second group of flexible members each has protrusion thereon, wherein the protrusions engage the second pair of opposed interior walls.

12. The muntin assembly of claim 11 wherein the first group of flexible members extend in a direction and the protrusions extend in a direction generally transverse to the direction of the first group of flexible members.

13. A muntin clip assembly adapted to be connected to a muntin bar end and a spacer frame, the assembly comprising:

a base member having a mounting structure adapted to be connected to the spacer frame; and a bar support extending from the base member and adapted to be connected to the muntin bar end, the bar support having a trunk, a first group of flexible members extending outwardly from the trunk, and a second group of flexible members attached to the trunk and extending in a direction substantially parallel to the trunk, wherein the second group of flexible members comprises a first flexible arm attached to a first side of the trunk, a second flexible arm attached to a second side of the trunk, a third flexible arm attached to the first side of the trunk, and a fourth flexible arm attached to the second side of the trunk, the second side of the trunk being opposed to the first side.

14. A muntin clip assembly adapted to be connected to a muntin bar end and a spacer frame, the assembly comprising:

a base member having a mounting structure adapted to be connected to the spacer frame; and a bar support extending from the base member and adapted to be connected to the muntin bar end, the bar support having a trunk, a first group of flexible members extending outwardly from the trunk, and a second group of flexible members attached to the trunk and extending in a direction substantially parallel to the trunk, wherein the second group of flexible members comprises a first flexible arm attached to a first side of the trunk and a second flexible arm attached to a second side of the trunk, the second side of the trunk being opposed to the first side, and wherein the first flexible arm has a first projection thereon, and the second flexible arm has a second projection thereon.

* * * * *